US011279146B2

(12) United States Patent
Stowitts et al.

(10) Patent No.: US 11,279,146 B2
(45) **Date of Patent: *Mar. 22, 2022**

(54) CONTAINER DECORATION APPARATUS AND METHOD

(71) Applicant: Ball Corporation, Broomfield, CO (US)

(72) Inventors: Adam P. S. Stowitts, Arvada, CO (US); Dean C. Ellefson, Lakewood, CO (US)

(73) Assignee: BALL CORPORATION, Broomfield, CO (US)

( * ) Notice: Subject to any disclaimer, the term of this patent is extended or adjusted under 35 U.S.C. 154(b) by 69 days.

This patent is subject to a terminal disclaimer.

(21) Appl. No.: 16/648,880

(22) PCT Filed: Sep. 19, 2018

(86) PCT No.: PCT/US2018/051719

§ 371 (c)(1),
(2) Date: Mar. 19, 2020

(87) PCT Pub. No.: WO2019/060396

PCT Pub. Date: Mar. 28, 2019

(65) Prior Publication Data

US 2020/0282745 A1 Sep. 10, 2020

Related U.S. Application Data

(60) Provisional application No. 62/579,236, filed on Oct. 31, 2017, provisional application No. 62/560,354, filed on Sep. 19, 2017.

(51) Int. Cl.
*B41J 3/407* (2006.01)
*B41J 2/005* (2006.01)
(Continued)

(52) U.S. Cl.
CPC ..... *B41J 3/4073* (2013.01); *B41F 17/22* (2013.01); *B41J 2/0057* (2013.01); *B41J 2/01* (2013.01);
(Continued)

(58) Field of Classification Search
CPC .. B41J 3/4073; B41J 3/40733; B41J 11/0085; B41J 2002/012; B41J 2/0057; B41F 17/22
(Continued)

(56) References Cited

U.S. PATENT DOCUMENTS 5,650,037 A 7/1997 Larson
5,799,574 A 9/1998 Williams et al.
(Continued)

FOREIGN PATENT DOCUMENTS

CA 2568736 C 5/2008
DE 202006000270 U1 5/2006
(Continued)

OTHER PUBLICATIONS

US 9,597,868 B2, 03/2017, Landa et al. (withdrawn)
(Continued)

*Primary Examiner* — An H Do
(74) *Attorney, Agent, or Firm* — Greer, Burns & Crain, Ltd.

(57) ABSTRACT

A container body decorator (10) has a controller (300) with a software stored in a memory. A plurality of ink-jet printing heads (108) is in communication with the controller (300). A segmented image transfer blanket (116) has a circumferential configuration with an inner surface opposite a printing surface. A printing site (124) is located along the segmented image transfer blanket (116). A container body handling module (200) delivers container bodies to the printing site (124).

26 Claims, 37 Drawing Sheets

(51) Int. Cl.

| | |
|---|---|
| ***B65B 43/50*** | (2006.01) |
| ***B65B 61/02*** | (2006.01) |
| ***B41F 17/22*** | (2006.01) |
| ***B41J 2/01*** | (2006.01) |
| ***B41J 11/00*** | (2006.01) |

(52) U.S. Cl.
CPC ..... *B41J 3/40731* (2020.08); *B41J 3/40733* (2020.08); *B41J 11/0085* (2013.01); *B65B 43/50* (2013.01); *B65B 61/025* (2013.01); *B41J 2002/012* (2013.01)

(58) Field of Classification Search
USPC ..... 347/2, 4, 101, 103, 104; 101/38.1, 39
See application file for complete search history.

(56) References Cited

U.S. PATENT DOCUMENTS

| | | | |
|---|---|---|---|
| 5,970,865 | A | 10/1999 | Horth et al. |
| 6,631,673 | B2 | 10/2003 | Aichele |
| 6,699,352 | B2 | 3/2004 | Sawatsky |
| 6,769,357 | B1 | 8/2004 | Finan |
| 6,854,947 | B2 | 2/2005 | Lee |
| 6,920,822 | B2 | 7/2005 | Finan |
| 7,013,624 | B2 | 3/2006 | Zwilling |
| 7,347,899 | B2 | 3/2008 | Day |
| 7,373,878 | B2 | 5/2008 | Finan |
| 7,517,623 | B2 | 4/2009 | Wu et al. |
| 7,540,236 | B2 | 6/2009 | Aichele |
| 8,256,854 | B2 | 9/2012 | Till |
| 8,408,694 | B2 | 4/2013 | Leykamm et al. |
| 8,418,608 | B2 | 4/2013 | Preckel |
| 8,708,271 | B2 | 4/2014 | Noll et al. |
| 8,899,718 | B2 | 12/2014 | Yamada et al. |
| 8,919,247 | B2 | 12/2014 | Morgavi et al. |
| 8,926,047 | B2 | 1/2015 | LaCaze et al. |
| 8,931,864 | B2 | 1/2015 | LaCaze |
| 9,032,872 | B2 | 5/2015 | Uptergrove |
| 9,090,090 | B2 | 7/2015 | Putzer et al. |
| 9,132,664 | B2 | 9/2015 | Schach |
| 9,186,884 | B2 | 11/2015 | Landa et al. |
| 9,193,146 | B2 | 11/2015 | Till |
| 9,221,275 | B2 | 12/2015 | Till |
| 9,229,664 | B2 | 1/2016 | Landa et al. |
| 9,259,952 | B2 | 2/2016 | Yamada et al. |
| 9,272,534 | B2 | 3/2016 | Domeier et al. |
| 9,290,016 | B2 | 3/2016 | Landa et al. |
| 9,302,463 | B2 | 4/2016 | Heidrich et al. |
| 9,327,493 | B1 | 5/2016 | Vella |
| 9,327,496 | B2 | 5/2016 | Landa et al. |
| 9,353,273 | B2 | 5/2016 | Landa et al. |
| 9,365,010 | B2 | 6/2016 | Preckel et al. |
| 9,381,736 | B2 | 7/2016 | Landa et al. |
| 9,415,607 | B2 | 8/2016 | Preckel et al. |
| 9,457,926 | B2 | 10/2016 | Schach |
| 9,463,616 | B2 | 10/2016 | Domeier et al. |
| 9,498,946 | B2 | 11/2016 | Landa et al. |
| 9,505,208 | B2 | 11/2016 | Shmaiser et al. |
| 9,517,618 | B2 | 12/2016 | Landa et al. |
| 9,517,623 | B2 | 12/2016 | LaCaze |
| 9,550,372 | B2 | 1/2017 | Vella |
| 9,566,780 | B2 | 2/2017 | Landa et al. |
| 9,568,862 | B2 | 2/2017 | Schmaiser et al. |
| 2005/0045053 | A1 | 3/2005 | Finan |
| 2006/0018698 | A1 | 1/2006 | Vogt |
| 2007/0157576 | A1 | 7/2007 | Till |
| 2010/0031834 | A1 | 2/2010 | Morgavi et al. |
| 2010/0257819 | A1 | 10/2010 | Schach |
| 2010/0295885 | A1 | 11/2010 | LaCaze |
| 2012/0044283 | A1 | 2/2012 | Silverbrook |
| 2012/0274695 | A1 | 11/2012 | LaCaze et al. |
| 2013/0075296 | A1 | 3/2013 | Ramsey et al. |
| 2014/0049585 | A1 | 2/2014 | Tashiro et al. |
| 2015/0024648 | A1 | 1/2015 | Landa et al. |
| 2015/0025179 | A1 | 1/2015 | Landa et al. |
| 2015/0118503 | A1 | 1/2015 | McDaniel et al. |
| 2015/0044431 | A1 | 2/2015 | Landa et al. |
| 2015/0072090 | A1 | 3/2015 | Landa et al. |
| 2015/0128819 | A1 | 5/2015 | Vella |
| 2015/0128821 | A1 | 5/2015 | Vella |
| 2015/0174891 | A1 | 6/2015 | Boas et al. |
| 2015/0174917 | A1 | 6/2015 | Noll et al. |
| 2015/0183211 | A1 | 7/2015 | Petti et al. |
| 2016/0001546 | A1 | 1/2016 | Hughes et al. |
| 2016/0016687 | A1 | 1/2016 | Ramsey et al. |
| 2016/0023471 | A1 | 1/2016 | Jeter |
| 2016/0136965 | A1 | 5/2016 | Sonnauer |
| 2016/0136968 | A1 | 5/2016 | Cassoni et al. |
| 2016/0136969 | A1 | 5/2016 | Allen et al. |
| 2016/0159087 | A1 | 6/2016 | Sonnauer |
| 2016/0200097 | A1 | 7/2016 | Shmaiser et al. |
| 2016/0207341 | A1 | 7/2016 | Landa et al. |
| 2016/0212968 | A1 | 7/2016 | Ritnour |
| 2016/0221328 | A1 | 8/2016 | Till |
| 2016/0221359 | A1 | 8/2016 | Till |
| 2016/0221360 | A1 | 8/2016 | Till |
| 2016/0221708 | A1 | 8/2016 | Ojima et al. |
| 2016/0222232 | A1 | 8/2016 | Landa et al. |
| 2016/0229198 | A1 | 8/2016 | Izume |
| 2016/0297190 | A1 | 10/2016 | Landa et al. |
| 2016/0297978 | A1 | 10/2016 | Landa et al. |
| 2016/0344896 | A1 | 11/2016 | Litvak et al. |
| 2016/0355025 | A1 | 12/2016 | Ojima et al. |
| 2016/0369119 | A1 | 12/2016 | Landa et al. |
| 2017/0008270 | A1 | 1/2017 | Fleischer et al. |
| 2017/0008272 | A1 | 1/2017 | Landa et al. |
| 2017/0050446 | A1 | 2/2017 | Clippingdale et al. |
| 2017/0056900 | A1 | 3/2017 | Cassoni et al. |
| 2017/0080706 | A1 | 3/2017 | Landa et al. |
| 2017/0113452 | A1 | 4/2017 | Boas et al. |
| 2017/0182705 | A1 | 6/2017 | Allen et al. |
| 2017/0113455 | A1 | 7/2017 | Landa et al. |

FOREIGN PATENT DOCUMENTS

| | | | |
|---|---|---|---|
| DE | 102011009391 | A1 | 7/2012 |
| DE | 202006021181 | U1 | 7/2013 |
| DE | 202006021180 | U1 | 8/2013 |
| DE | 102012213079 | A1 | 1/2014 |
| DE | 102013214934 | A1 | 2/2015 |
| DE | 102013215637 | A1 | 3/2015 |
| DE | 102013217668 | A1 | 3/2015 |
| DE | 102014206730 | A1 | 10/2015 |
| DE | 102014108092 | A1 | 12/2015 |
| DE | 102104213813 | A1 | 1/2016 |
| DE | 102014225405 | A1 | 6/2016 |
| EP | 0209896 | A2 | 1/1987 |
| EP | 1468827 | A1 | 10/2004 |
| EP | 1011971 | B1 | 7/2009 |
| EP | 2479036 | A1 | 7/2012 |
| JP | 2000141777 | A | 5/2000 |
| JP | 2004042464 | A | 2/2004 |
| WO | 02085553 | A1 | 4/2002 |
| WO | 2012131478 | A2 | 3/2012 |
| WO | 2016008702 | A1 | 6/2015 |
| WO | 2016008705 | A1 | 6/2015 |
| WO | 2016071444 | A1 | 11/2015 |

OTHER PUBLICATIONS

Russian Search Report and Office Action for corresponding Russian Patent Application No. 2020112909 dated Dec. 9, 2020.
International Search Report; priority document.
Chinese Office Action for corresponding Chinese Patent Application No. 201880067452.8 dated Jul. 16, 2021.

CONTAINER DECORATION APPARATUS AND METHOD

CROSS-REFERENCE TO RELATED APPLICATIONS

This Application is a United States National Stage Application under 35 U.S.C. Section 371 of International Patent Application No. PCT/US2018/051719 filed on Sep. 19, 2018, which is hereby incorporated by reference as if fully set forth herein. This Application also claims priority to and the benefit of U.S. Provisional Application No. 62/560,354, filed Sep. 19, 2017, and U.S. Provisional Application No. 62/579,236, filed Oct. 31, 2017, which are also hereby incorporated by reference as if fully set forth herein.

FEDERALLY SPONSORED RESEARCH OR DEVELOPMENT

N/A

TECHNICAL FIELD

The invention relates to container decoration; more particularly, the invention relates to an apparatus for continuously decoration, without interruption, a queue of beverage cans with selectively differing designs.

BACKGROUND OF THE INVENTION

Recent developments in metallic beverage container body decorating allow manufacturers to produce consecutively decorated beverage container bodies having unique finished art relative to each other on a single dry offset beverage container body decorator. Prior to these recent developments, consecutively decorated beverage container bodies exhibited identical finished art. Some of these recent developments are disclosed in U.S. Patent Application Publication No. 2015/0174891 A1 corresponding to U.S. application Ser. No. 14/412,585, which is hereby incorporated by reference as if fully set for herein and for a particular purpose of describing the dry rotary offset printing process as it relates to metallic beverage container bodies for two-piece beverage containers.

In a typical dry rotary offset beverage container body decorator, cartridges are supplied with colored ink that is eventually applied onto a cylindrical sidewall of the metal beverage container body. The printing apparatus is provided with an ink cartridge for each color that one wishes to apply onto the metal beverage container body.

The ink cartridges supply ink to printing plates, which have art in relief corresponding to finished art to be printed onto the metal beverage container. This finished art may be a text, a figure, or any type of graphic which one wishes to make on a metal beverage container. Thus, it is very important to position the printing plate correctly relative to the metal beverage container and the ink cartridges.

It is also important to note that the relief art present on the printing plates is in high relief wherein ink supplied to the art in high relief on the printing plates transfers to a transfer blanket. This transfer blanket is an ink transferring means between the printing plates and the metal beverage container to be printed, generally produced from a rubber, rubber-like, or other pliable material.

The ink-laden relief features on each printing plate come into contact with a single transfer blanket. Thus, each transfer blanket receives ink from a plurality of printing plates to produce a finished artwork design. This is carried out by rotation of a printing plate, which transfers the ink present in relief to the transfer blanket, which is fixed on a transfer blanket drum, which has a rotation synchronized with (i) the metal beverage container bodies to be printed, (ii) the positioning of the transfer blankets that are on the surface of the transfer blanket drum, and (iii) the printing plates.

Each beverage container body engages just one transfer blanket to receive a complete finished art design of multiple colors that the transfer blanket has received from a plurality of printing plates.

The synchronization between elements makes it possible to decorate the metal beverage container bodies in a precise manner. This is of the utmost importance in metal beverage container printing. There should be no overlapping of the print on the metal beverage container when it receives ink corresponding to the art exhibited by the plurality of printing plates from a single transfer blanket.

In other words, the art on a first printing plate will transfer ink only to a predetermined area of a first transfer blanket. A second printing plate will transfer ink on its surface to another area on the first transfer blanket that did not receive ink from the first printing plate, and so on. This is dependent on the number of printing colors on the metal beverage containers.

It is also important to note that, when one wishes to change the finished art present on the beverage container bodies in a manufacturing queue, it is necessary to interrupt the production, that is, the decoration apparatus must be stopped. Such stoppage is necessary, because there may be the need to change the printing color of the beverage container body, or to change a beverage container body for a different product.

For example, when one is carrying out a type of beverage container body decoration and wants to change the finished art present on the beverage container bodies, it is necessary to interrupt the decorating process. In short, typical decorating processes and equipment, only allow one type of finished art printed on the beverage container bodies with the same decoration apparatus. If it is necessary to change the finished art on the beverage container body, the production will necessarily have to be interrupted, which for economical reason should be minimized as much as possible.

This can be easily observed through the order or magnitude of beverage container body decorating. With the present-day equipment, one can decorate approximately 2.5 million beverage container bodies in a single day.

A recent development in beverage container body decorating includes providing art in the form of relief features on the transfer blankets. Thus, rather than having a single flat surface that receives ink from the printing plates, each transfer blankets has art in relief, typically low relief engravings or cooperating regions in high and low relief, to produce differing final images on consecutively decorated metallic beverage container bodies on a dry offset rotary beverage container body decorator. This recent improvement allows a manufacturer to decorate beverage containers bodies in a manufacturing queue continuously and without interruption wherein consecutive beverage container bodies are decorated with different images.

However, this prior process limits the manufacturer to a maximum of N different designs on N consecutively decorated beverage container bodies, where N is the number of transfer blankets on a given decorating apparatus. There is a need within the industry to produce an unlimited number of finished art designs on consecutively decorated beverage container bodies within the industry.

Additionally, small-batch beverage producers are becoming increasingly more popular. Unfortunately, due to the economies associated with producing decorated beverage container bodies, small-batch beverage produces can be limited to purchasing unadorned beverage container bodies and will often add a sleeve of some sort to adorn the beverage container bodies with source identifying indicia.

The present invention is provided to solve the problems discussed above and other problems, and to provide advantages and aspects not provided by prior beverage can decorators of this type. A full discussion of the features and advantages of the present invention is deferred to the following detailed description, which proceeds with reference to the accompanying drawings.

SUMMARY OF THE INVENTION

One aspect of the invention is directed to a container body decorator which comprises a controller having a software routine stored on a memory, a plurality of ink-jet printing heads in communication with the controller, a segmented image transfer blanket having a circumferential configuration comprising a plurality of print surfaces each separated by a gap in the segmented image transfer blanket, and a beverage container body handling module.

Another aspect of the invention is directed to a container body decorator which comprises a controller having a software routine stored on memory, a segmented image transfer blanket having a plurality of blanket segments affixed to a rigid carousel, each blanket segment having a printing surface opposite an inner surface, a plurality of ink-jet printing heads mounted along a circumference of the segmented image transfer blanket and configured to deposit an ink pattern onto the printing surface of the segmented image transfer blanket, the plurality of ink-jet printing heads responsive to a signal received from the controller corresponding to a desired shape and color the ink pattern, an impression roll located opposite the carousel such each blanket segment of the segmented image transfer blanket passes therebetween defining a printing site, and a beverage container body handling module comprising a rotational indexer configured to sequentially transport a plurality of beverage container bodies to and from the printing site.

Another aspect of the present invention is directed to a container body decorator which comprises a controller having a software routine stored on memory, a segmented image transfer blanket operatively joined to at least one servo motor, the segmented image transfer blanket having a plurality of printing surface opposite an inner surface, each printing surface separated by an adjacent printing surface by a gap, a plurality of ink-jet printing heads mounted along a circumference of the segmented image transfer blanket and configured to deposit an ink pattern onto the printing surface of segmented image transfer blanket, the plurality of ink-jet printing heads responsive to a signal received from the controller corresponding to a desired shape and color the ink pattern, a pressure member located within the circumference of the segmented image transfer blanket and engaging the inner surface of the segmented image transfer blanket at a printing site of the container body decorator, and a beverage container handling module. The beverage container handling module comprises a first rotary delivery turret having a plurality of pockets configured to transfer each beverage container body in a queue of a plurality of beverage container bodies sequentially to a rotary print turret, the rotary print turret having a plurality of pockets configured to transfer each beverage container body in the queue of the plurality of beverage container bodies sequentially to a printing site arranged along a circumference of the segmented image transfer blanket, the rotary turret rotatable about an axis to sequentially bring each pocket to the printing site, a plurality of impression rolls insertable within an interior of a beverage container body wherein one impression roll of the plurality of impression rolls is located within the interior of the beverage container body when the beverage container body is located at the printing cite, the one impression roll supporting a sidewall of the beverage container body such that the sidewall is positioned between the one impression roll and the printing surface of the segmented image transfer blanket, a second rotary delivery turret having a plurality of pockets configured to transfer each beverage container body in a queue of a plurality of beverage container bodies sequentially from the rotary print turret to a further process.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Referring generally to the figures, embodiments of the present invention are illustrated. Each embodiment is directed to a container decorating apparatus or decorator 10.

The containers may be any metallic, generally cylindrical container, such as those used in packaging solids, liquids, foods, aerosols, beverages and the like, but are preferably the body portion of a two-piece aluminum beverage can. In each embodiment, container bodies are fed or transferred sequentially, one-by-one, via one or more container body handling modules to a printing site where finished art is transferred from a segmented image transfer blanket to the container body.

Figure 15:
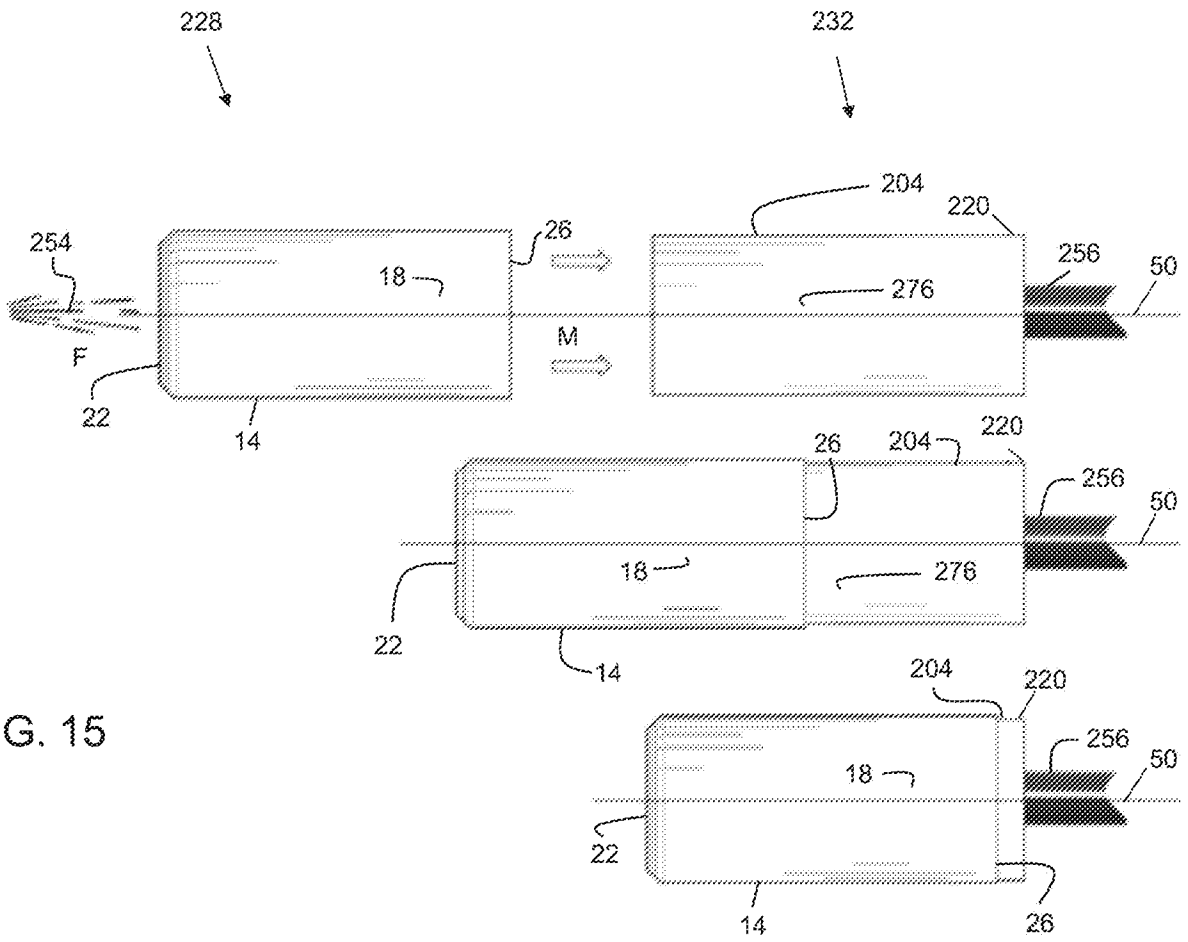
FIGS. 15 and 16 show a process of loading and unloading a beverage can on and from an impression roll.
Figure 16:
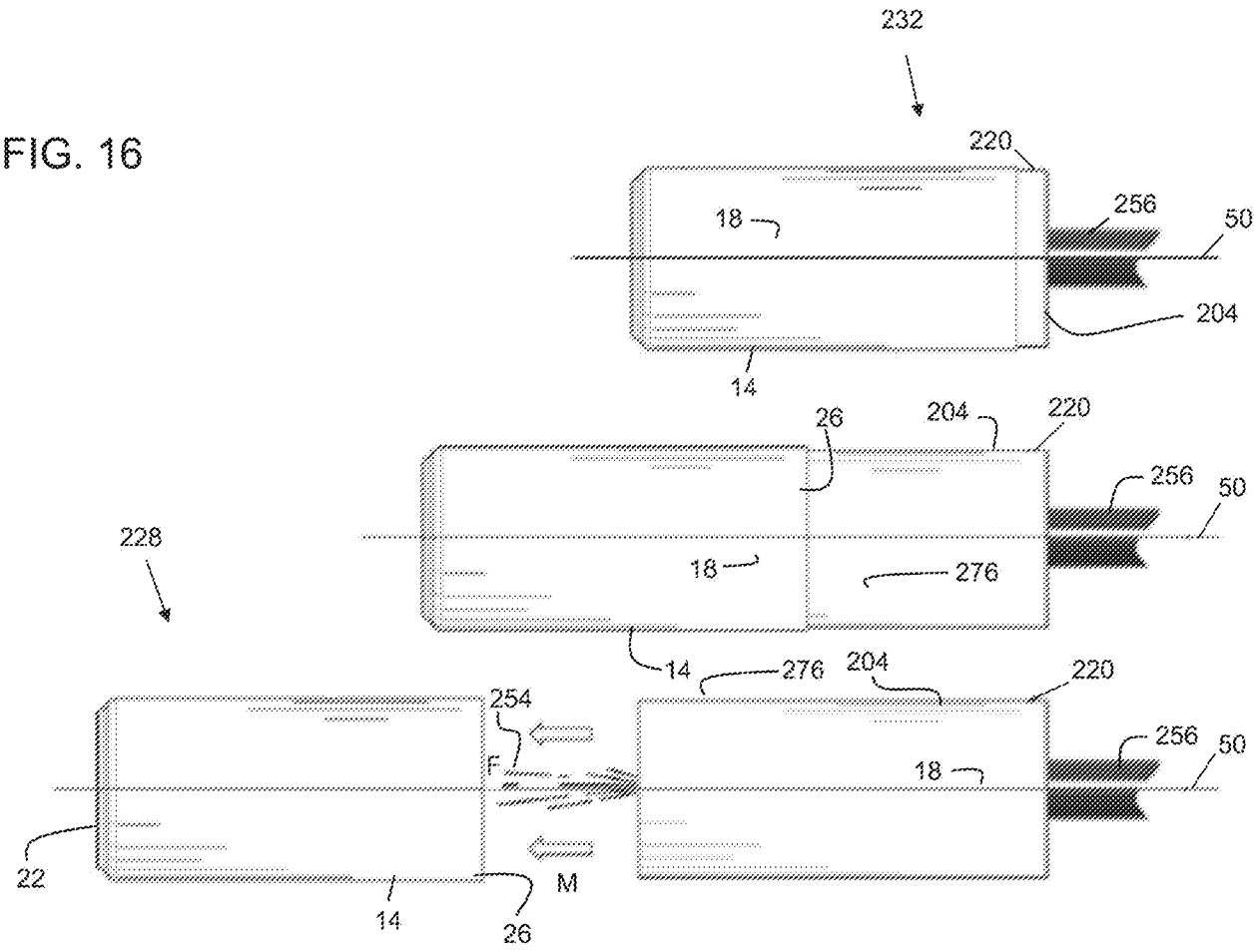

An example of one such beverage container body 14 is illustrated in FIGS. 15 and 16. The beverage container bodies 14 have a cylindrical sidewall 18 enclosed by an integral bottom 22 opposite an open end 26. Again, while the embodiments are described relating to the decorating of metallic beverage container bodies, in practice the container bodies can be intended for any of the end uses describes above.

Figure 17:
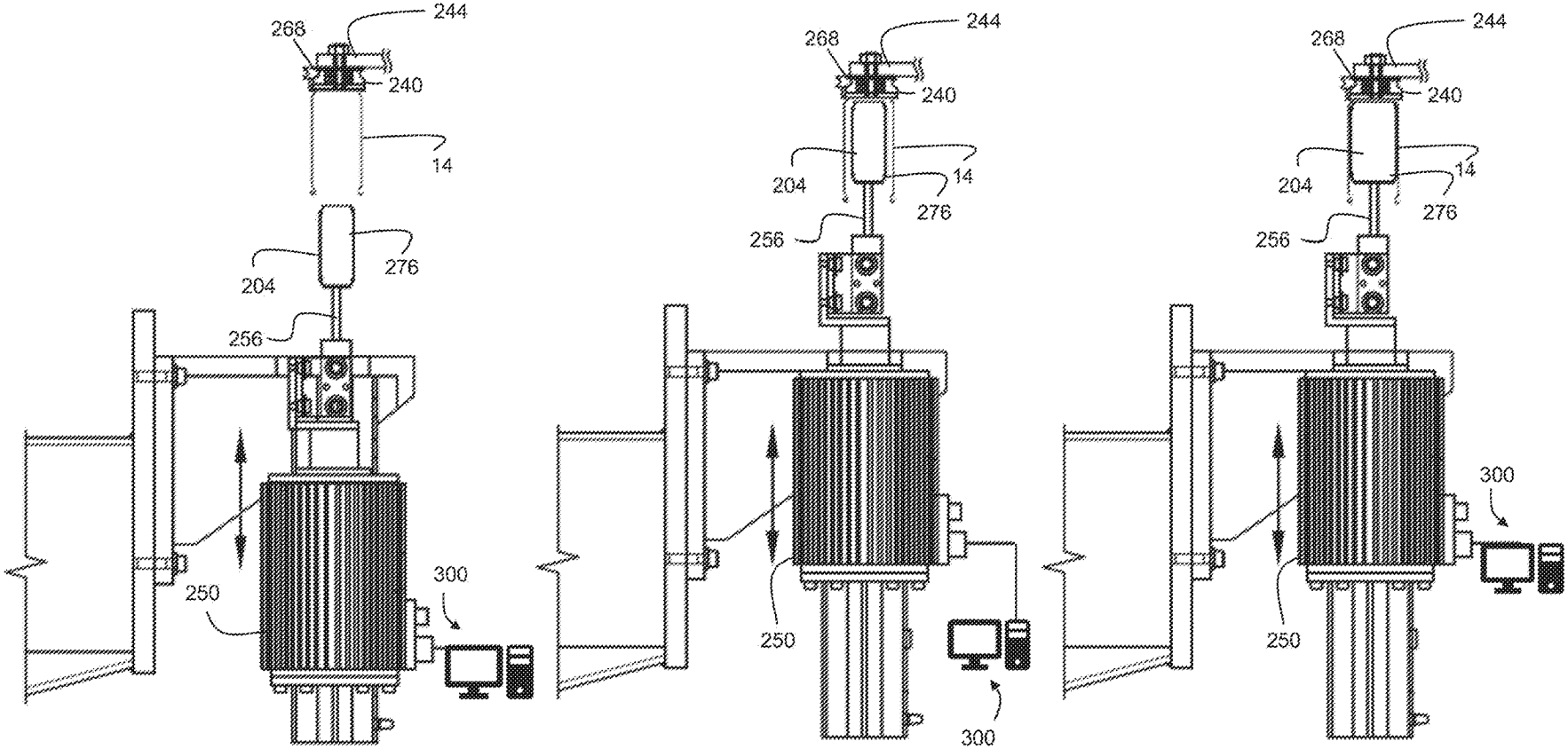
FIG. 17 is a top view of an arrangement for transferring an electroactive polymer impression roll into and out of a necked and flanged beverage container body at a printing site which can be used in combination with the beverage container body handling modules illustrated in FIGS. 9-11.

Another example of a beverage container body 14 is illustrated in FIG. 17. Here, the beverage container bodies 14 have been necked to reduce the size of the opening in the open end 26 and flanged for receiving a can end or lid which will be double seamed to the container body 14 subsequent to filling with a beverage or other liquid. Again, while the embodiments are described relating to the decorating of metallic beverage container bodies, in practice the container bodies can be intended for any of the end uses describes above.

Embodiments of the present invention have at least one printing module, at least one beverage container handling module, and a controller or processor generally included in a computer system comprising a memory having one or more software routines stored thereon. These three elements work together to adorn beverage container bodies 14 with a pattern of ink in a desired design, preferably multiple desired ink designs directly on a metallic sidewall of the beverage container body, rather than on a paper, polymeric, or other such printable substrate label. Elements of the printing module are designated using reference numerals between 100-199. Elements of the beverage container handling module are designated with reference numerals between 200-299.

Generally, the embodiments described provide many technical benefits and effects over prior decorators. For example, these embodiments reduce or eliminate lost production due to equipment changeovers (e.g., printing plates, blankets, ink cartridges, ink colors, and the like) where finished art or designs on the containers are changed or altered. Variability from container to container is reduced. The printing or decorating is made simpler as there is no longer a need for multiple, individual transfer blankets and a custom ink color inventory. Finally, the color pantone and method of using the apparatus allows for true artistic screening through color combination and tonal shading that is not available in dry offset printing apparatuses where overlap of ink is avoided.

Further, the invention provides a moving blanket assembly with target areas for variable decoration. Designs or decorations are generated onto blanket segments in an intermediate step and one or more systems handling move containers to and through the system wherein decorations are transferred from blanket to container. This invention provides a repeatable, high-speed and low-cost digital decoration to a container.

In a broad sense, the invention provides a digital decorator, with a segmented blanket(s) and one or more can handling systems to position the containers to pick up an image left on the segmented blanket by one or more ink-jet printing heads. The apparatus may continuously move the containers through the processes/machine. Alternatively, the apparatus dwells at key locations within the method of printing (e.g. during loading, printing, inspecting, and unloading). The apparatus may utilize an indexing means through a series of positions throughout the process/machine. Each one being essentially equal in duration or following a pattern/timing sequence.

The container handling may be a continuous linked chain type of configuration, a combination of pocketed wheels, mandrels, pins, etc. driven by a center drive (e.g. a star wheel). Container may include a linear shuttle type where the dwells, stops and movements are programmable.

In this invention, a segmented blanket is utilized to receive and transfer ink to containers. Output/speed may be set by the rotational speed of a blanket carousel. The is speed can be matched or synchronized with continuous and semi-continuous container handing indexing. The speed can be synched to pick up alternating blanket segments. Container rotation van be driven by the carousel (i.e. blanket contact with the containers) or the containers can be pre-spun prior to reaching a printing site Printing Modules Each embodiment of the present invention includes a printing module 100. The printing module 100 has an inker unit 104 comprising a plurality of printing heads 108, typically 4 and preferable inkjet printing heads. The printing heads 108 deliver a volume of ink 112 in a desired pattern to a segmented image transfer blanket 116. Each ink-jet printing head 108 delivers a quantity of ink 112 to the blanket 116 to produce a desired pattern of ink 112 in a desired color, preferably multiple colors.

The segmented image transfer blanket 116 is supported such that it is rotatable about a center axis, such that the ink 112 pattern traverses from a location adjacent the printing heads 108 to a printing site 124 where engagement (i.e. contact) between the sidewall of the beverage container body 14 and the segmented image transfer blanket 116 transfers the ink 112 to impart the finished art directly on the sidewall.

The segmented image transfer blanket 116 has a plurality of blanket segments 118 spaced about the periphery of a rigid carousel 120. A combination of the blanket segments 118 affixed to the carousel 120 forms the segmented image transfer blanket 116. Each blanket segment 118 is separated from an adjacent blanket segment 118 by a gap 121. The gap 121 may be a recessed surface of the segmented image transfer blanket 116, at least relative to the printing surfaces 132. Each blanket segment 118 has a printing surface 132 configured to accept the volume of ink 112 from the ink-jet printing heads 108 and transfer the ink 112 to the beverage container body sidewalls 18. Thus, a segmented image transfer blanket 116 may have a gap 121 between adjacent blanket segments 118 which has a surface height which is recessed in relation to the printing surfaces 132 of the adjacent blanket segments 118.

Figure 21:
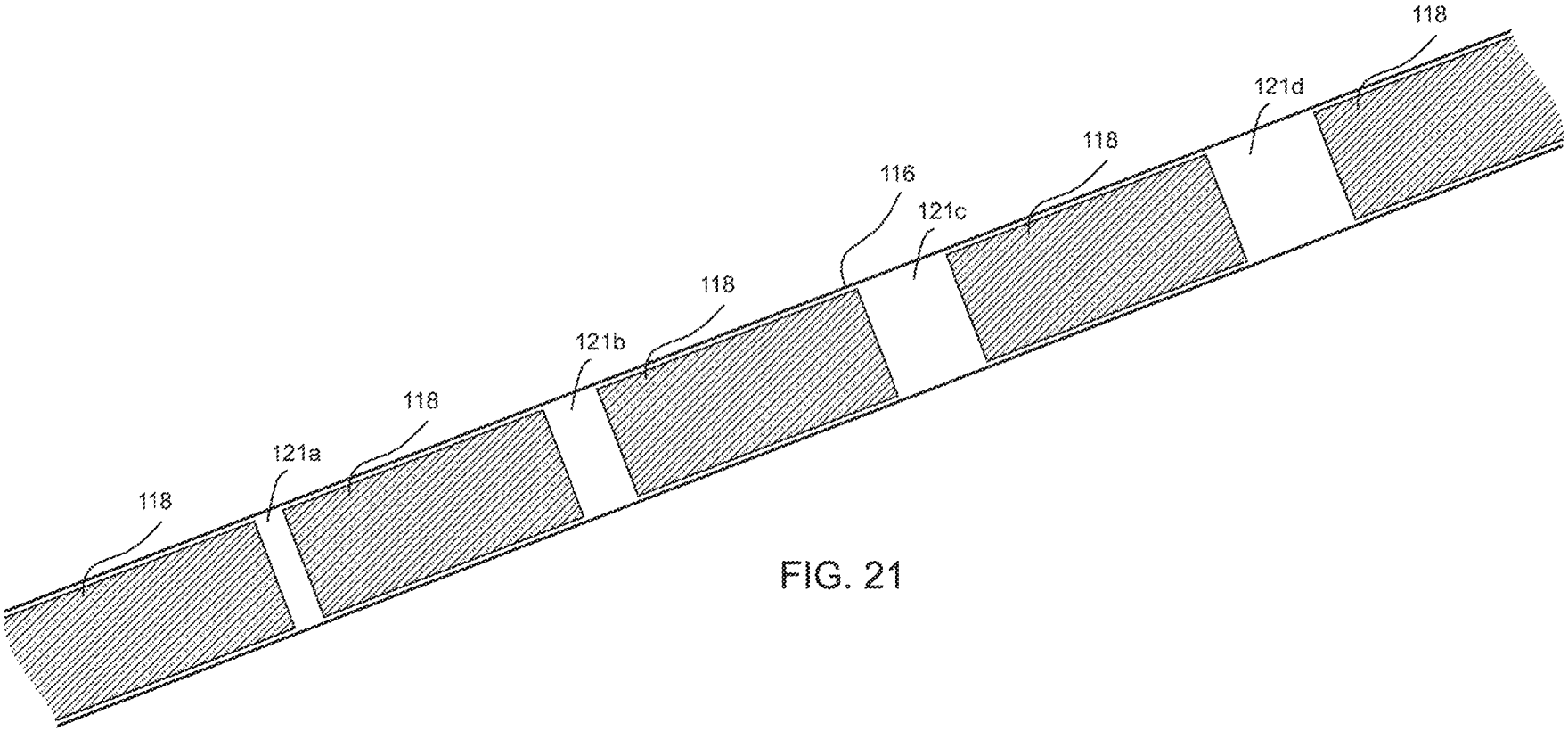
FIG. 21 is a partial top view of a segmented image transfer blanket having gaps of variable length.
Figure 22:
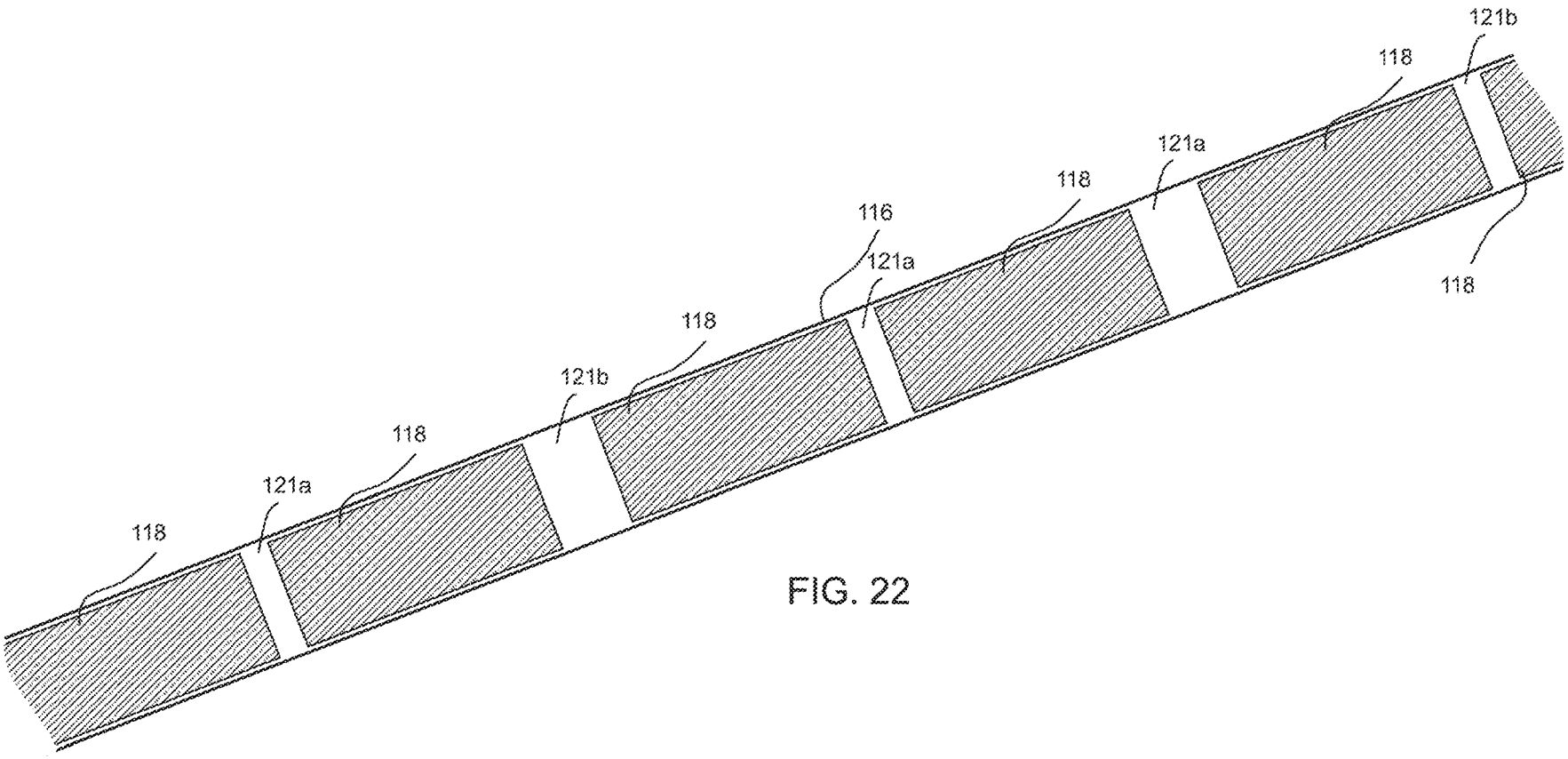
FIG. 22 is a partial top view of a segmented image transfer blanket having gaps of variable length.

The gaps 121 may have a constant length. That is, a distance between adjacent blanket segments 118 be a constant over an entire length or circumference of the segmented image transfer blanket 116. Alternatively, the gaps 121*a-d* may have fixed but variable lengths as illustrated in FIGS. 21 and 22. That is, distances between adjacent blanket segments 118 can vary over the length or circumference of the segmented image transfer blanket 116 but the gaps 121*a-d* are fixed in that they do not change. In other words, a first blanket segment 118 can be closer to its adjacent blanket segment or blanket segments 118 than a second blanket segment 118 to its adjacent blanket segment or blanket segments 118. Stated another way, some gaps 121*a* are shorter than other gaps 121*b* (see FIG. 22), or the gaps 121*a-d* can be configured in a pattern of progressively increasing lengths as illustrated in FIG. 21. It follows, also, that a blanket segment 118 may nearer or closer to a first adjacent blanket segment 118 than it is to a second adjacent blanket segment 118 on an opposite side of the blanket segment 118. A segmented image transfer blanket 116 as illustrated in FIGS. 21 and 22 may feature all of these structural blanket segment arrangements.

It is further important that in some embodiments, for example FIGS. 23-31, the gap 121 lengths themselves are variable during operation. That is, the gap 121 lengths between adjacent blanket segments 118 can be varied, i.e. the gap distances are not fixed. The gaps 121 being smaller when the blanket segments 118 are receiving ink 112 from the ink-jet printing heads 108. These gaps 121 can be wider as the blanket segments 118 reach the printing site or sites 124. This enhances the timing of the apparatus 10 to operate continuously or to print containers within particular dwell periods.

Figure 23:
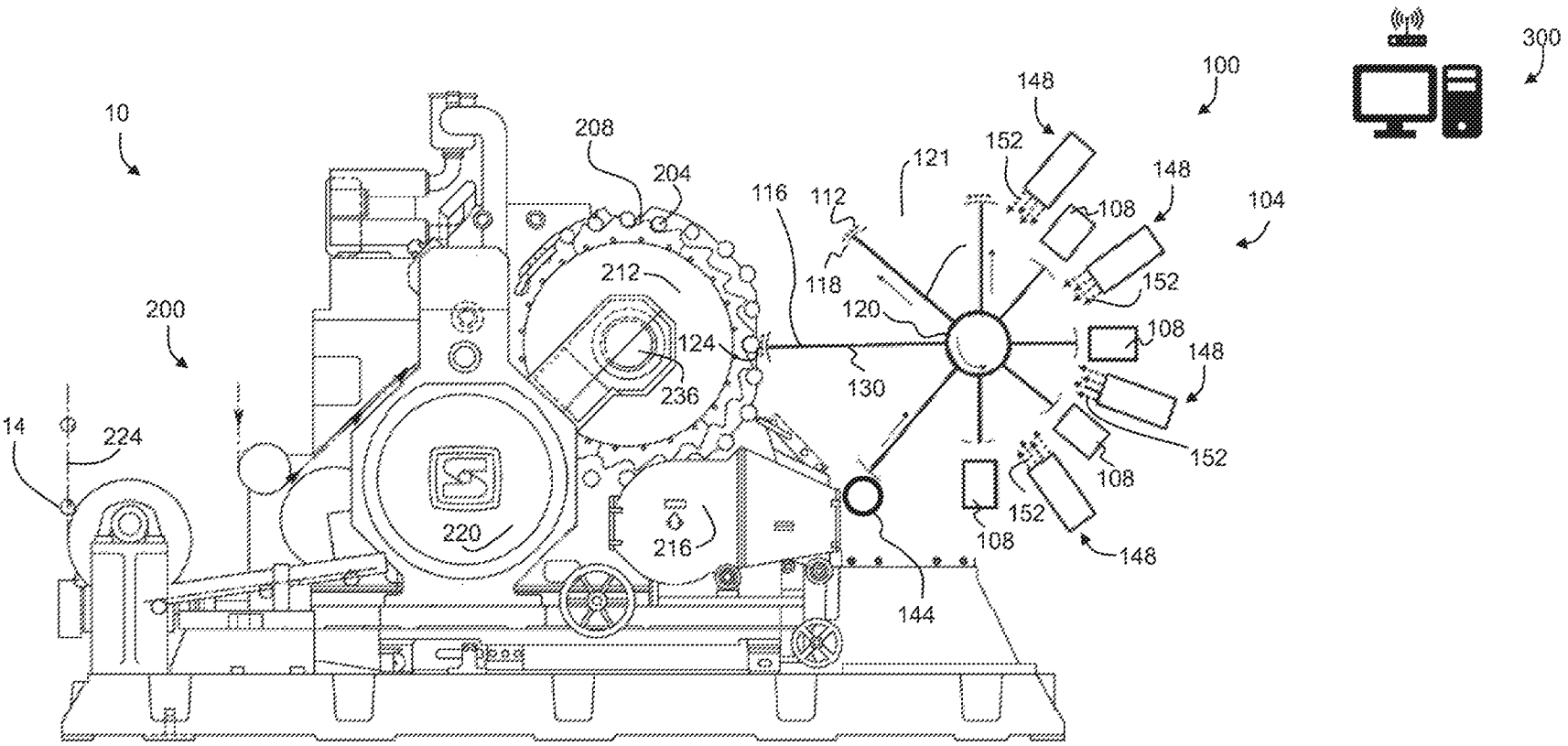
FIG. 23 is a side plan view of an offset printing apparatus according to the invention incorporating a segmented image transfer blanket having variable gaps by extensible blanket segments, a plurality of ink-jet printing heads, and a computer for controlling a beverage container body decorating process, including image generation and apparatus mechanical function.

One form of a variable gapped segmented image transfer blanket 116 is illustrated, for example, in FIG. 23. Here, the carousel 120 includes a plurality of extensible blanket segments 118. The blanket segments 118 are located at terminal ends of arms 130 having lengths that can be varied relative to a rotational axis of the carousel 120. To increase the gap 121, an arm is extended radially outwardly relative to the axis of rotation of the carousel 120.

Figure 24:
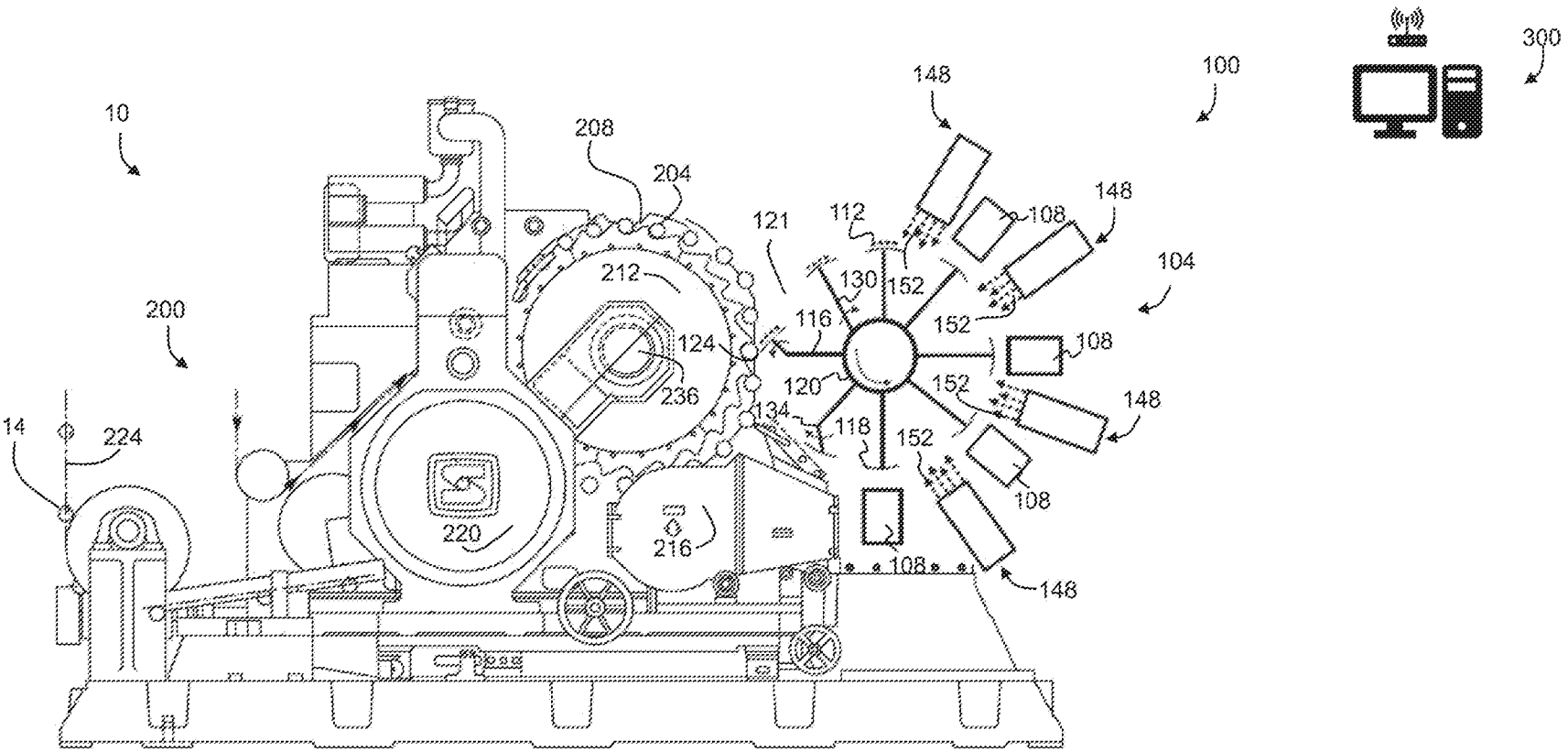
FIG. 24 is a side plan view of an offset printing apparatus according to the invention incorporating a segmented image transfer blanket having variable gaps by deflectable blanket segments, a plurality of ink-jet printing heads, and a computer for controlling a beverage container body decorating process, including image generation and apparatus mechanical function.

Another form of a variable gapped segmented image transfer blanket 116 is illustrated in, for example, FIG. 24. Here, the carousel 120 includes a plurality of deflectable blanket segments 118. The blanket segments 118 are located at terminal ends of arms 130 having lengths that can be varied relative to a rotational axis of the carousel 120 by pivoting a distal end of the arm 130 which carries the blanket segment 118 about a pivot point 134 such that a distance from the blanket segment 118 to the axis of rotation of the carousel 120 is decreases upon deflection of the distal end of the arm 130. A proximal end of the arm 130 remains in a fixed distance from the axis of rotation of the carousel 120. In operation, the distal end of the arm 130 deflects after receiving ink 112 but prior to reaching the printing site 124. The distal end then pivots in the direction of rotation of the carousel, indicated by arrows, during printing at the printing site 124. The deflection can be used to accelerate and decelerate the blanket segment 118 in relation to the ink-jet printing heads 108, the printing site 124, etc. This enables timing of the apparatus and the method of the apparatus to be controlled, preferably by a controller. Preferably, this allows a blanket segment 118 to remain within the inker unit 104 and under the ink-jet printing heads 108 for a longer duration relative to a duration the same blanket segment 118 engages a container body 14 at the printing site 124 during printing.

Figure 20:
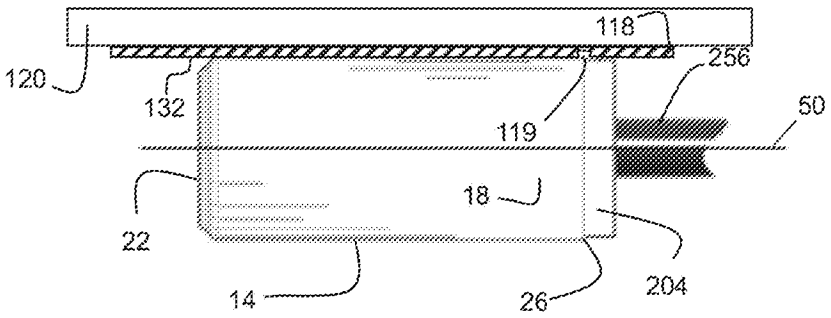
FIG. 20 is a side view of a beverage container body decorating process where the blanket segment has a recessed portion.

The segmented image transfer blanket 116 of the present invention may include recessed low relief features 119 formed thereon (see FIG. 20). As illustrated in FIG. 20, relief feature 119 may be a recessed band recessed into the print surface 132 in each blanket segment 118 of the segmented image transfer blanket 116 and configured to align with an edge of an open end 26 of a beverage container body 14 such that the edge is spaced from the printing surface 132 during a transfer of ink from the segmented image transfer blanket 116 to the beverage container body 14.

The segmented image transfer blanket 116 may be endless. In other words, it may form a continuous circumferential member. This form can be created by fixing ends of an elongated member together by any suitable chemical or mechanical means, such as welding, adhesives, clips, etc. Alternatively, the segmented image transfer blanket 116 can be integrally formed such that there is no seam between end thereof. The segmented image transfer blanket 116 may be stretched about the carousel 120 which maintains tension in the segmented image transfer blanket 116 and drives the segmented image transfer blanket 116 on a circumferential path. Accordingly, the carousel 120 may be driven by a servo motor or the like which is synchronized appropriately with a rotational indexer 212 wherein ink 112 on the printing surface 132 of the segmented image transfer blanket 116 is transferred to beverage container bodies 14 at the printing site 124.

Alternatively, the segmented image transfer blanket may comprise a plurality of blanket segments 118. Each blanket segment 118 is attached to the carousel 120 and spaced from an adjacent blanket segment 118 to form a gap 121 between adjacent blanket segments 118. The gap 121 is merely a surface of the carousel 120.

Figure 19:
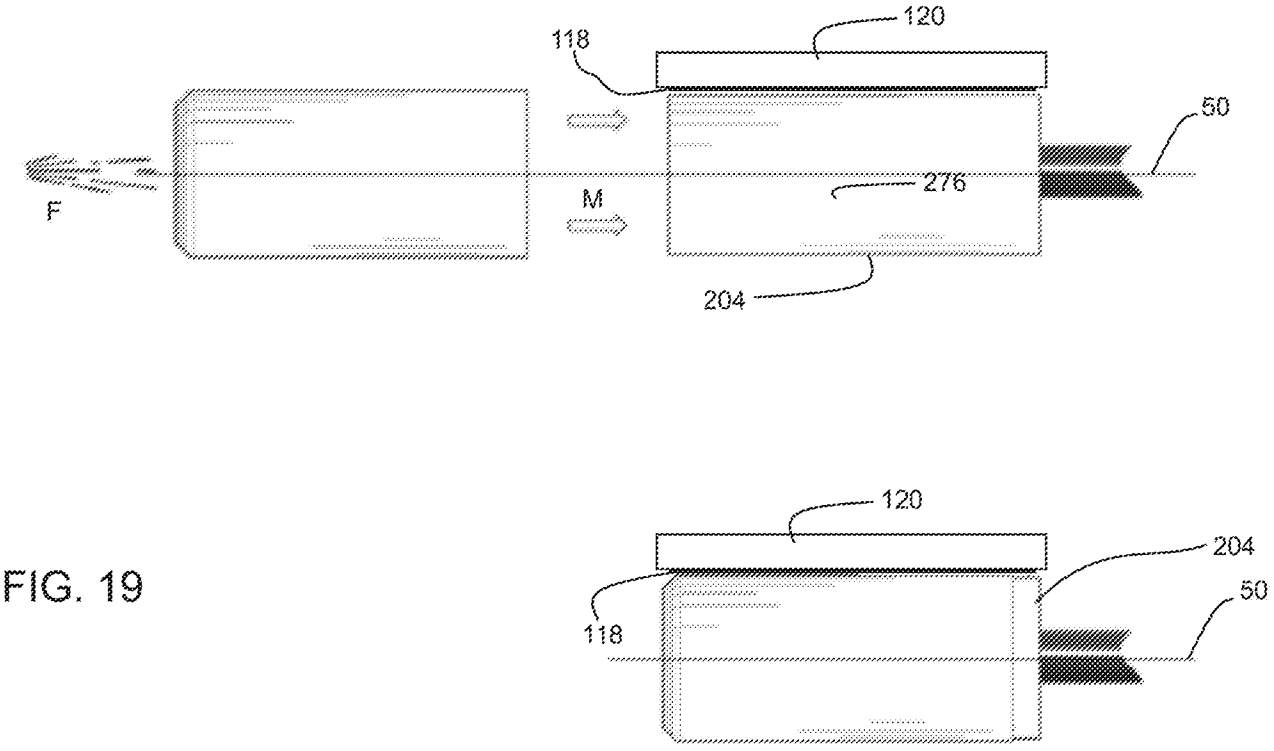
FIG. 19 is a side view of beverage container body decoration process.

At the printing site 124, each blanket segment 118 of the segmented image transfer blanket 116 is sandwiched between the carousel 120 and an impression roll 204 on which a beverage container body 14 is supported (see, e.g. FIGS. 19 and 20).

The ink 112 pattern is transferred to the beverage container body sidewall 18 by compressive force between the carousel 120 and the impression roll 204 on the beverage container body sidewall 18 and the segmented image transfer blanket 116. More specifically, the carousel 120 engages the blanket segments 118 of the segmented image transfer blanket 116 such that printing surface 132 carrying the desired pattern of ink 112 is forced against one of the plurality of beverage container bodies 14 supported on an impression roll 204 as the beverage container body 14 rotates about a center axis of the impression roll 204 as the impression roll 204 also orbits a central hub 236. The gaps 121 in the segmented image transfer blanket 116 do not engage the beverage container bodies 14 or impression rolls 204 of the beverage container handling modules.

Figure 1:
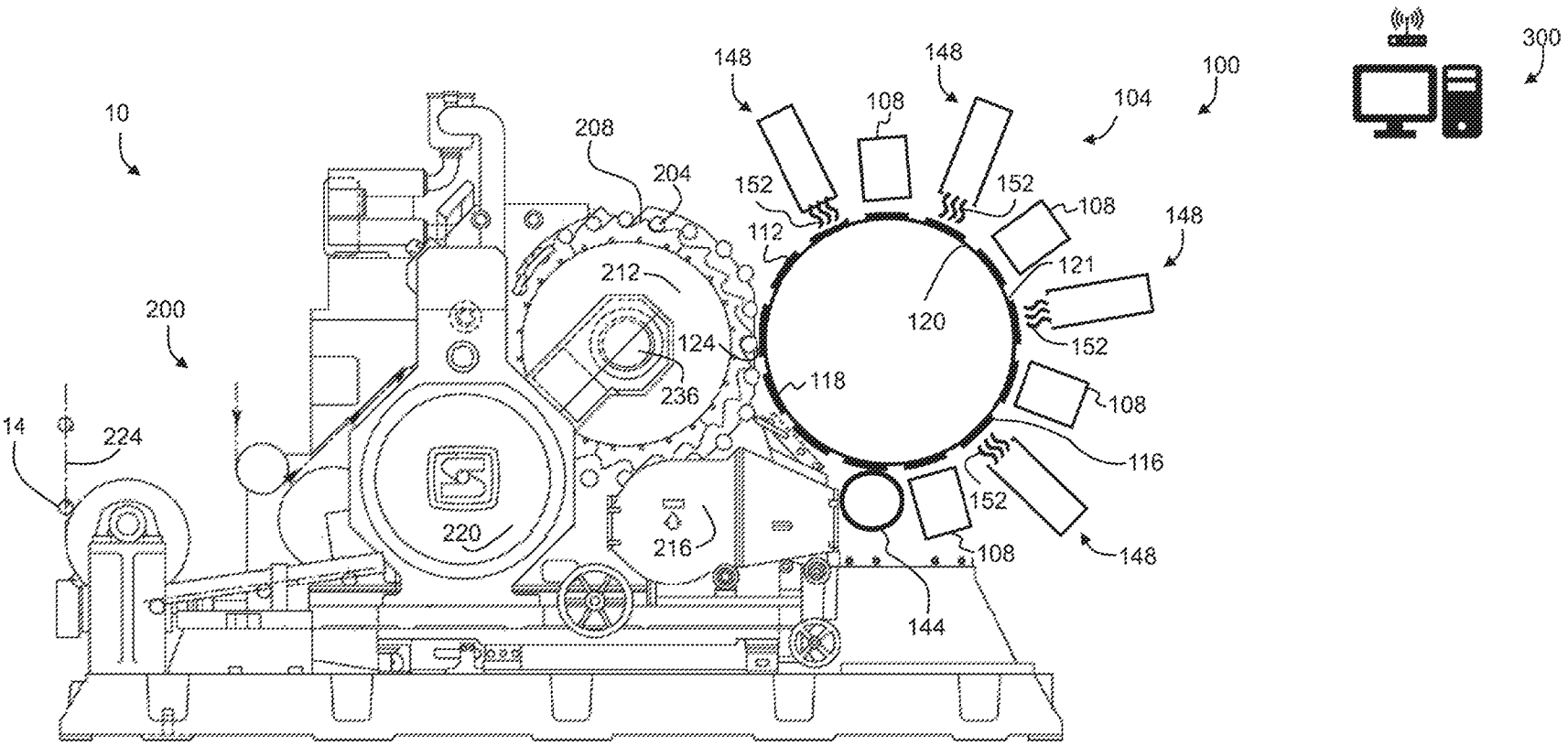
FIG. 1 is a side plan view of an offset printing apparatus according to the invention incorporating a segmented image transfer blanket, a plurality of ink-jet printing heads, and a computer for controlling a beverage container body decorating process, including image generation and apparatus mechanical function.
Figure 2:
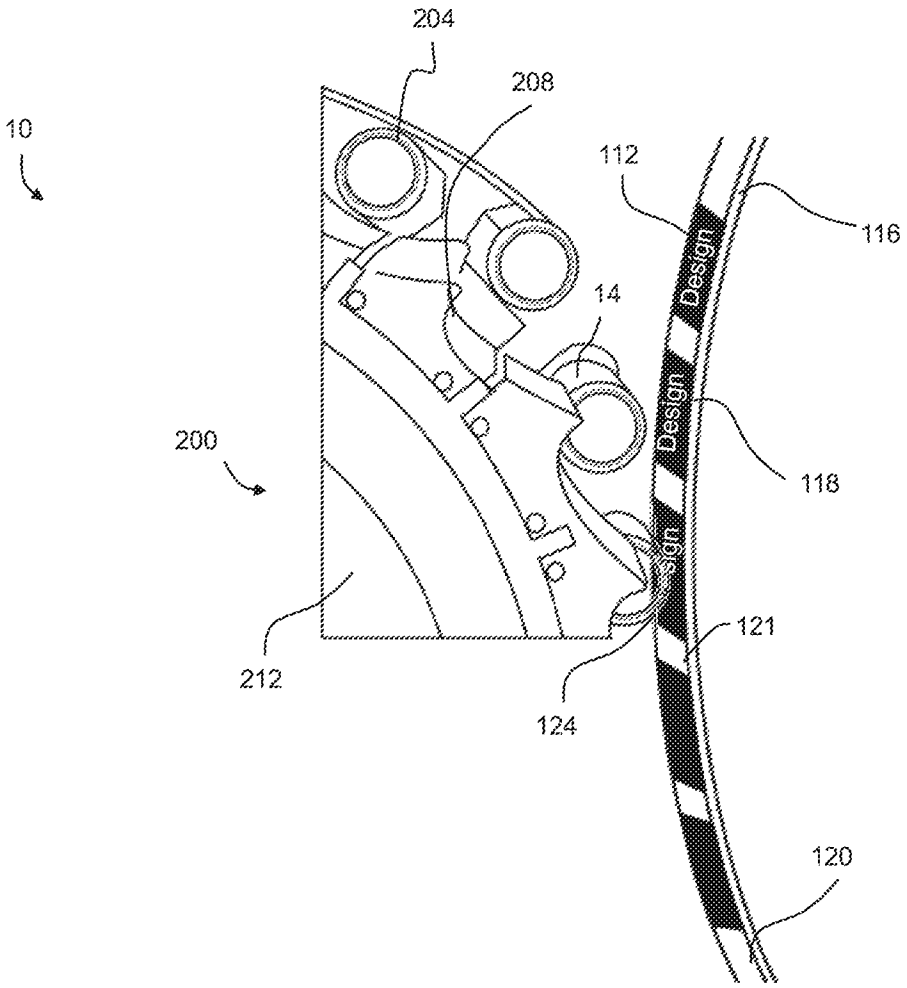
FIG. 2 is a partial view of an offset printing apparatus similar to FIG. 1 showing a printing site.

The printing site 124 may be arranged for horizontal delivery of the ink 112 on the segmented image transfer blanket 116 to the beverage container body as illustrated in, for example, FIGS. 1 and 2. Accordingly, at the printing site 124, the segmented image transfer blanket 116 may be a mere point along the circumferential path of the segmented image transfer blanket 116 where a line tangent to region is substantially vertical (i.e. ±5° of vertical), more preferably vertical.

Alternatively, the printing module 100 can be configured such that the ink 112 is delivered vertically. Accordingly, at the printing site 124 may be a mere point along the circumferential path of the segmented image transfer blanket 116 where a line tangent to region is substantially horizontal (i.e. ±5° of horizontal), more preferably horizontal. (See, e.g., FIG. 3).

The carousel 120 ensures a proper application of force between the segmented image transfer blanket 116 and the impression roll 204 to effect ink 112 transfer to the beverage container bodies 14.

A cleaning roll 144 may be provided downstream from the printing site 124 to remove ink 112 that is not transferred from the segmented image transfer blanket 116 to the beverage container bodies 14 from the segmented image transfer blanket 116. Accordingly, the cleaning roll 144 engages the printing surface 132 of the blanket segments 118 of the segmented image transfer blanket 116 as the segmented image transfer blanket 116 traverses along its circumferential route back by the printing heads 108.

The printing module 100 may be outfitted with one or more ink curing stations 148. Each ink curing station 148 may comprise a source of heat 152. The heat 152 pre-cures the ink 112 on the image transfer blanket 116 to minimize wet on beverage container body 14 issues. This creates a more stable ink 112 as an ink image or pattern prior to transferring the ink 112 to the beverage container body 14. Due to printing to the segmented image transfer blanket and pre-curing, multiple color dots can be combined to generate a larger color pantone options with base colors. In many embodiments, an ink curing station 148 is disposed after each printing head 108.

These printing modules 100 allow a one-touch application of an entire graphic which allows for a more simply built decorator 10 than prior art offset decorators which require wet laydown for each color. Continuous application of ink 112 onto the segmented image transfer blanket allows for the limiting speed factor of the printing head 108 to be maximized. Printing head 108 jetting onto a receptive segmented image transfer blanket in a repeatable position/condition segmented image transfer blanket as opposed to a moving round beverage container body with a variable surface leads to consistency and speed.

Figure 13:
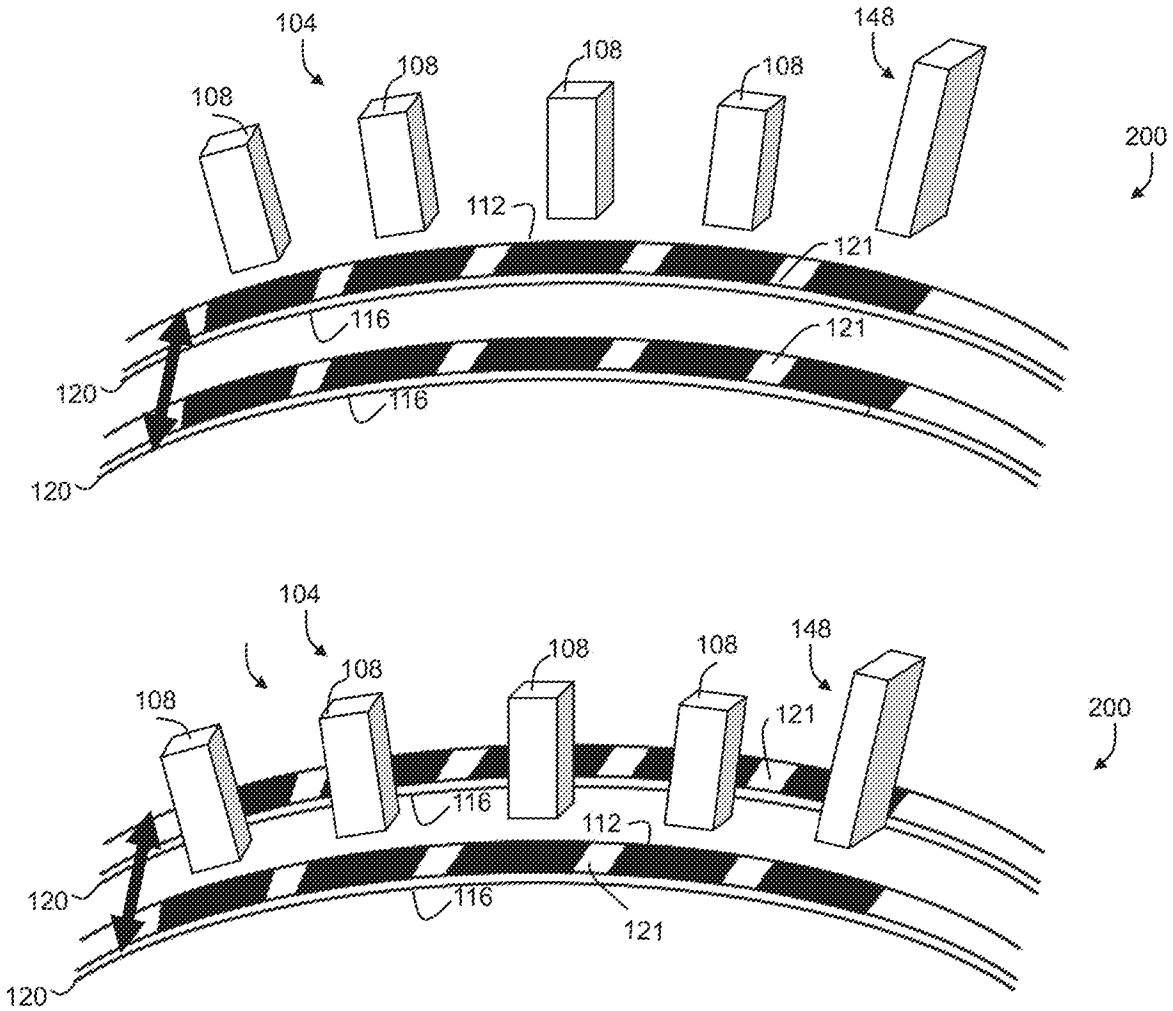
FIG. 13 is an alternative table top beverage can decoration apparatus employing a pair of the segmented image transfer blankets in parallel and a movable inker unit movable back and forth between the two segmented image transfer blankets, a mirror image handling module has been removed for simplicity of illustration.

In at least one embodiment, the inker unit 104 is movable between adjacent segmented image transfer blankets 116 as illustrated in FIG. 13. Here, a single inker unit 104 moves laterally as shown by the two-headed arrow from a first segmented image transfer blanket 116 to a second segmented image transfer blanket 116 and back again.

Beverage Container Body Handling Modules

Several beverage container handling modules 200 are shown in the figures. Each beverage container handling module 200 comprises at least one impression roll 204. The impression rolls 204 are inserted within the open ends 26 of the beverage container bodies 14 and provide a support against which the printing, or image transfer, from the segmented image transfer blanket 116 takes place. Preferably, the impression rolls 204 do not engage the printing surface 132 of the segmented image transfer blanket 116 during printing of the beverage container body sidewall 18 at the printing site 124. Stated another way, the impression rolls 204 do not contact the segmented image transfer blanket 116 during operation of the decorator 10. The decorators 10 are configured such that the beverage container body sidewalls 18 engage the printing surface 132 of the segmented image transfer blanket in the absence of engagement of the impression rolls 204 with the segmented image transfer blanket 116 (see FIG. 19).

Referring specifically to the embodiment illustrated in FIGS. 1, 2, 23, and 24, a high-speed decorator 10 incorporating a beverage container handling module 200 is illustrated. This beverage container body handling module 200 is capable of continuously delivering beverage container bodies 14 to a printing site 124 without interruption.

Here, undecorated beverage container bodies 14 are delivered to pockets 208 located at the periphery of a rotational indexer 212. Generally horizontal impression rolls 204 are also mounted to the indexer 212. Each impression roll 204 is in angular alignment with a pocket 208, but axially offset therefrom. The undecorated beverage container bodies 14 are mechanically transferred from the pockets 208 to the impression rolls 204 as the container body bottoms 22 engage a tapered or angled surface which urges the open end 26 of the container bodies 14 onto the impression rolls 204. The beverage container bodies 14 are decorated while mounted on the impression rolls 204 as the beverage container bodies 14 are delivered to the printing site 124 by the impression rolls 204 and brought into engagement with the continuously rotating segmented image transfer blanket 116. Thereafter, and while still mounted to impression rolls 204, decorated beverage container bodies 14 may have a protective film of varnish applied thereto by engagement with an applicator roll in an overvarnish unit 216.

The decorated beverage container bodies 14 are transferred from the impression rolls 204 to retainers, such as vacuum chucks 244, mounted to a transfer turret 220. The beverage container bodies 14 are then deposited on generally horizontal pins carried by chain-type output conveyor 224 which transfers the decorated beverage container bodies 14 to and through a curing process, such as a curing oven or ultrasonic curing station.

Figure 3:
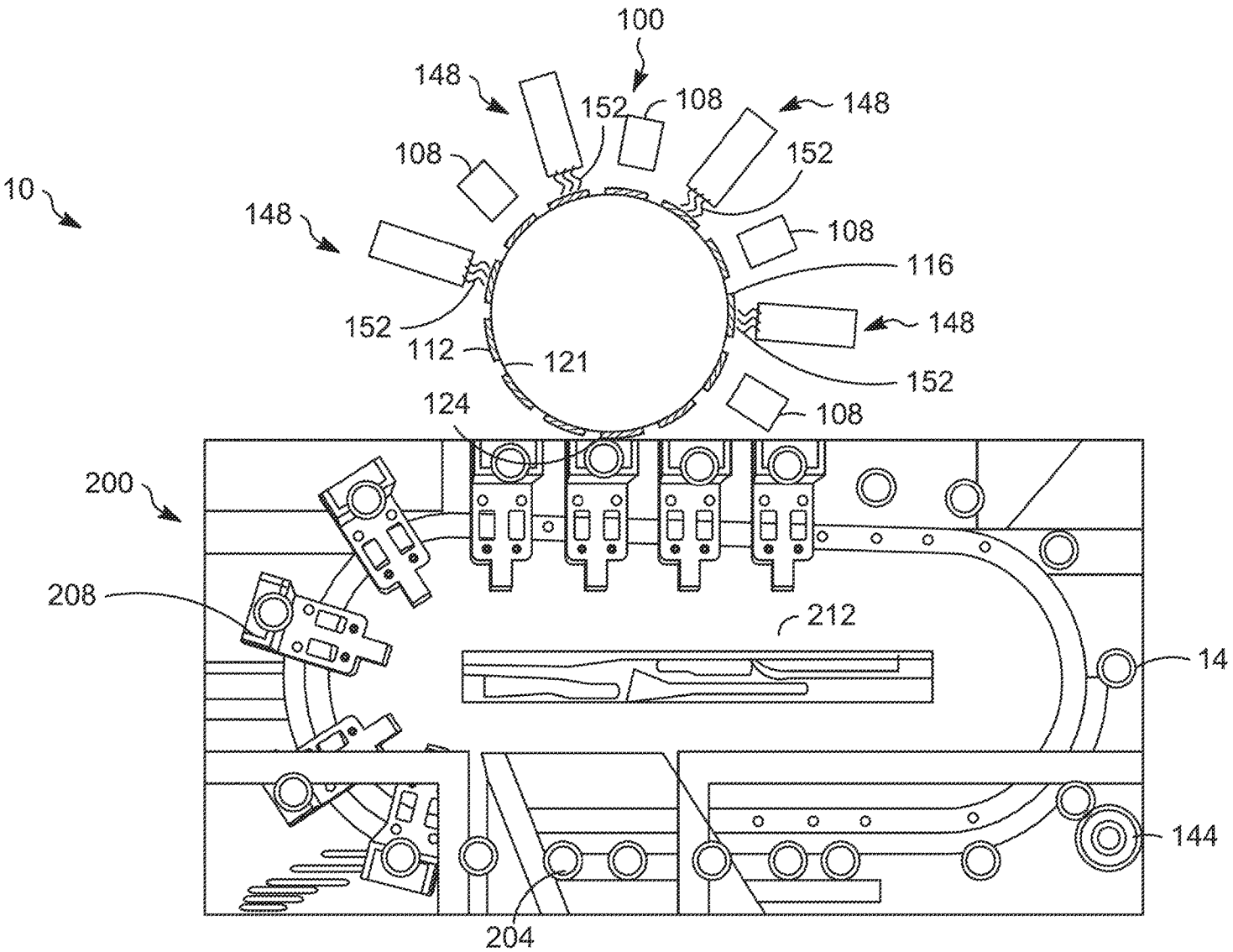
FIG. 3 is side view of an embodiment of the present invention employing a single printing site along a circumference of a segmented image transfer blanket and a beverage container body handling module comprising a means for transferring multiple impression rolls one-by-one to the printing site continuously and without interruption.

In FIG. 3, an alternative beverage container body handling module 200 is illustrated. Like the previous example, beverage container bodies 14 are loaded onto a plurality of impression rolls 204, which are then transported to a printing site 124 where image transfer takes place.

Figure 4:
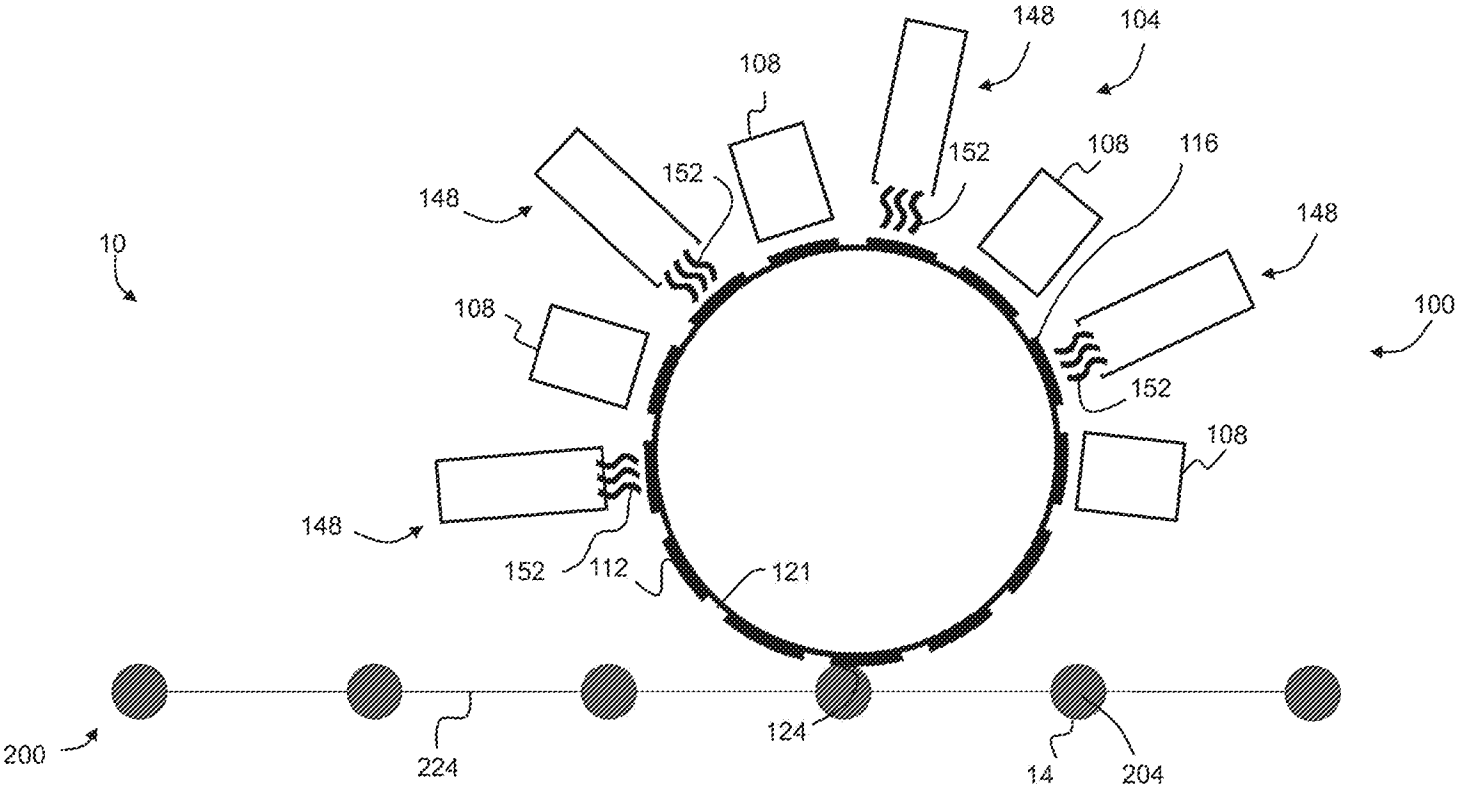
FIG. 4 is an embodiment of the invention a single printing module and a single beverage container body handling module with a chain driven beverage container handling module.

In FIG. 4, an alternative beverage container handling module 200 includes a chain 224 on which a multiple impression rolls 204 are attached and brought into alignment a printing site 124.

Figure 5:
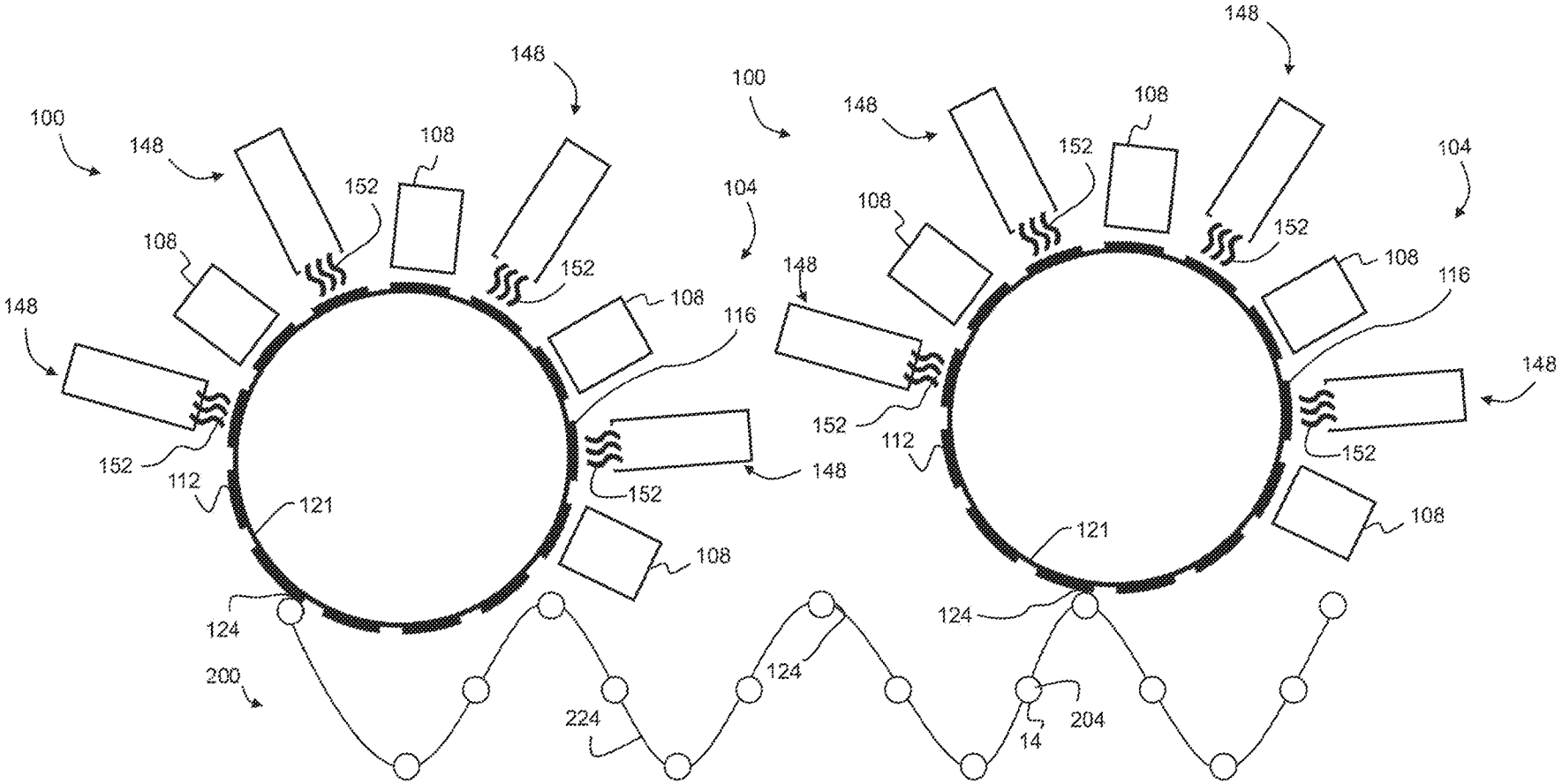
FIG. 5 is an embodiment of the featuring multiple printing sites on a single printing module and a single beverage container body handling module with a serpentine chain driven beverage container handling module.

In FIG. 5, an alternative beverage container handling module 200 includes a chain 224 on which multiple impression rolls 204 are attached and brought into alignment with a plurality of printing sites 124. In this embodiment, the chain 224 follows a serpentine path. This embodiment also allows multiple beverage container bodies 14 to be decorated simultaneously. In the example illustrated, two beverage container bodies 14 are simultaneously decorated.

Figure 6:
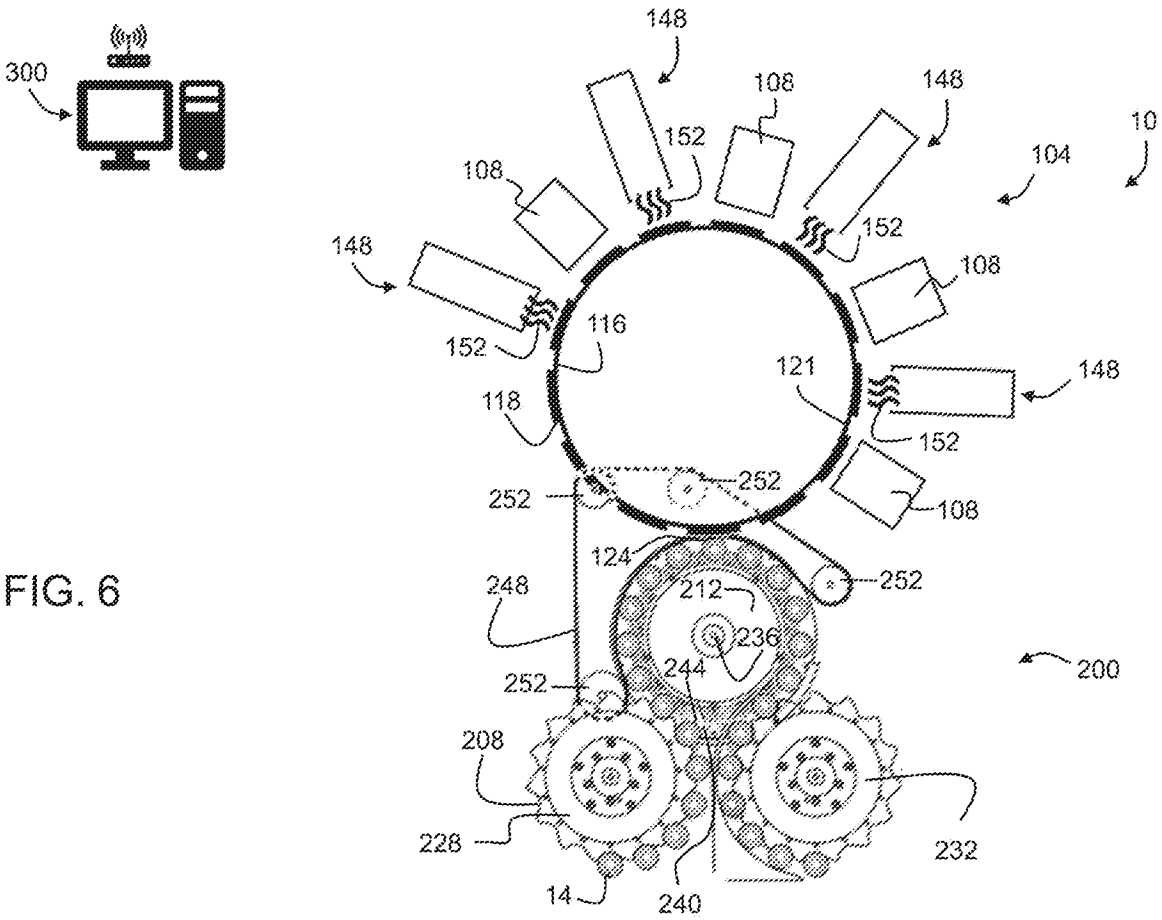
FIG. 6 is an embodiment of the invention showing a beverage can handling module featuring a rotary indexer and transfer wheels for delivering beverage container bodies to and from the indexer.
Figure 7:
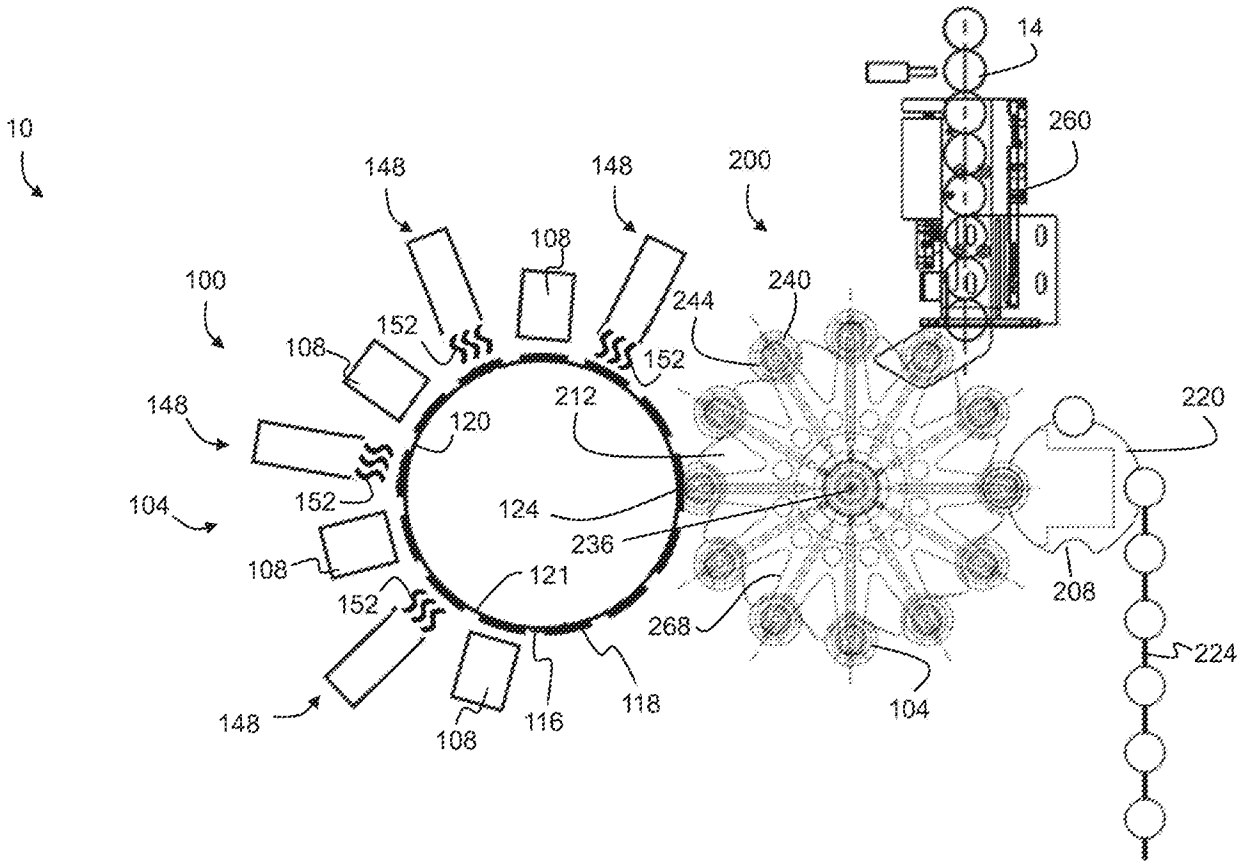
FIG. 7 is an embodiment of the invention showing a rotary beverage can handling module.
Figure 8:
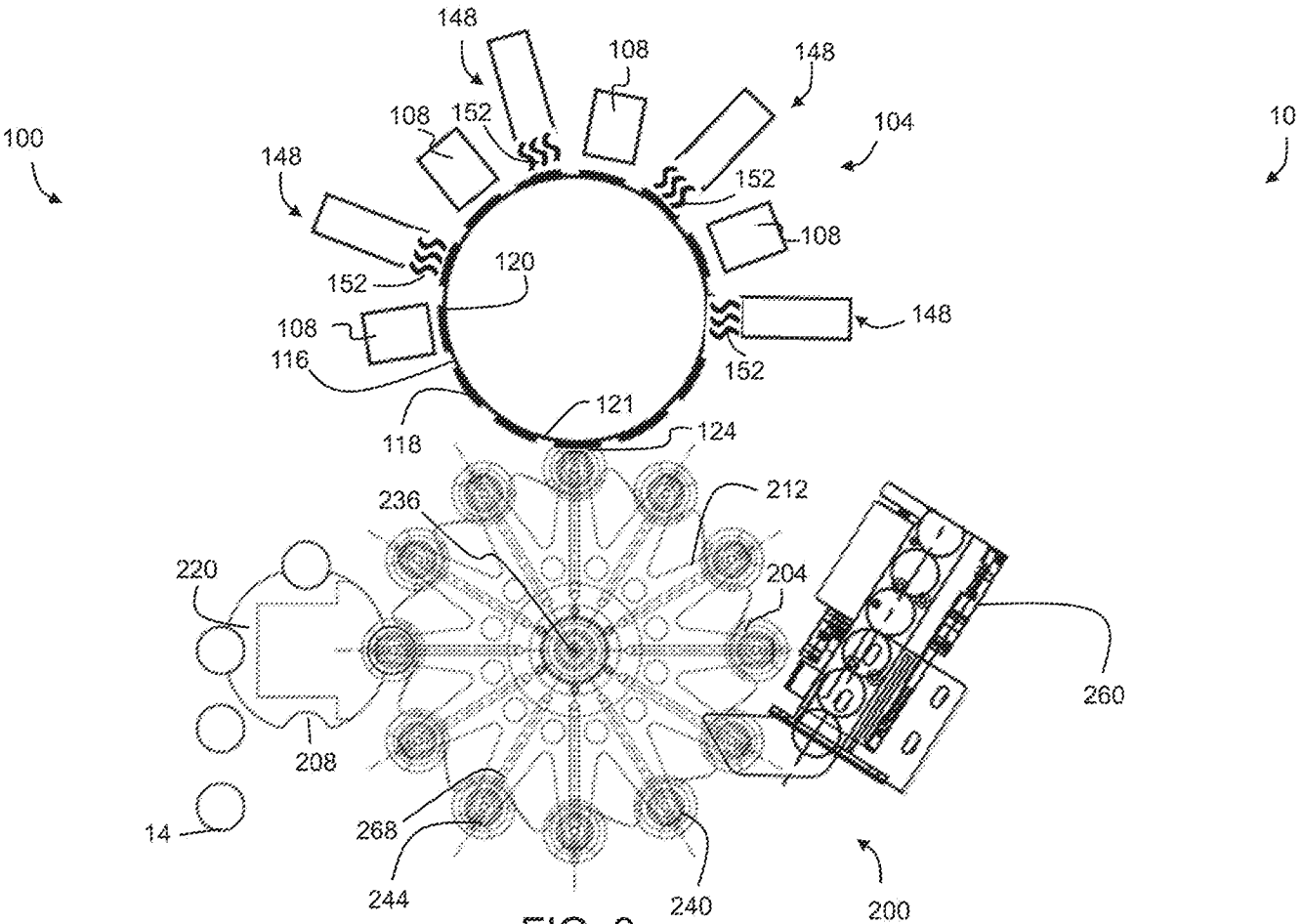
FIG. 8 is an embodiment of the invention showing a rotary beverage can handling module.
Figure 25:
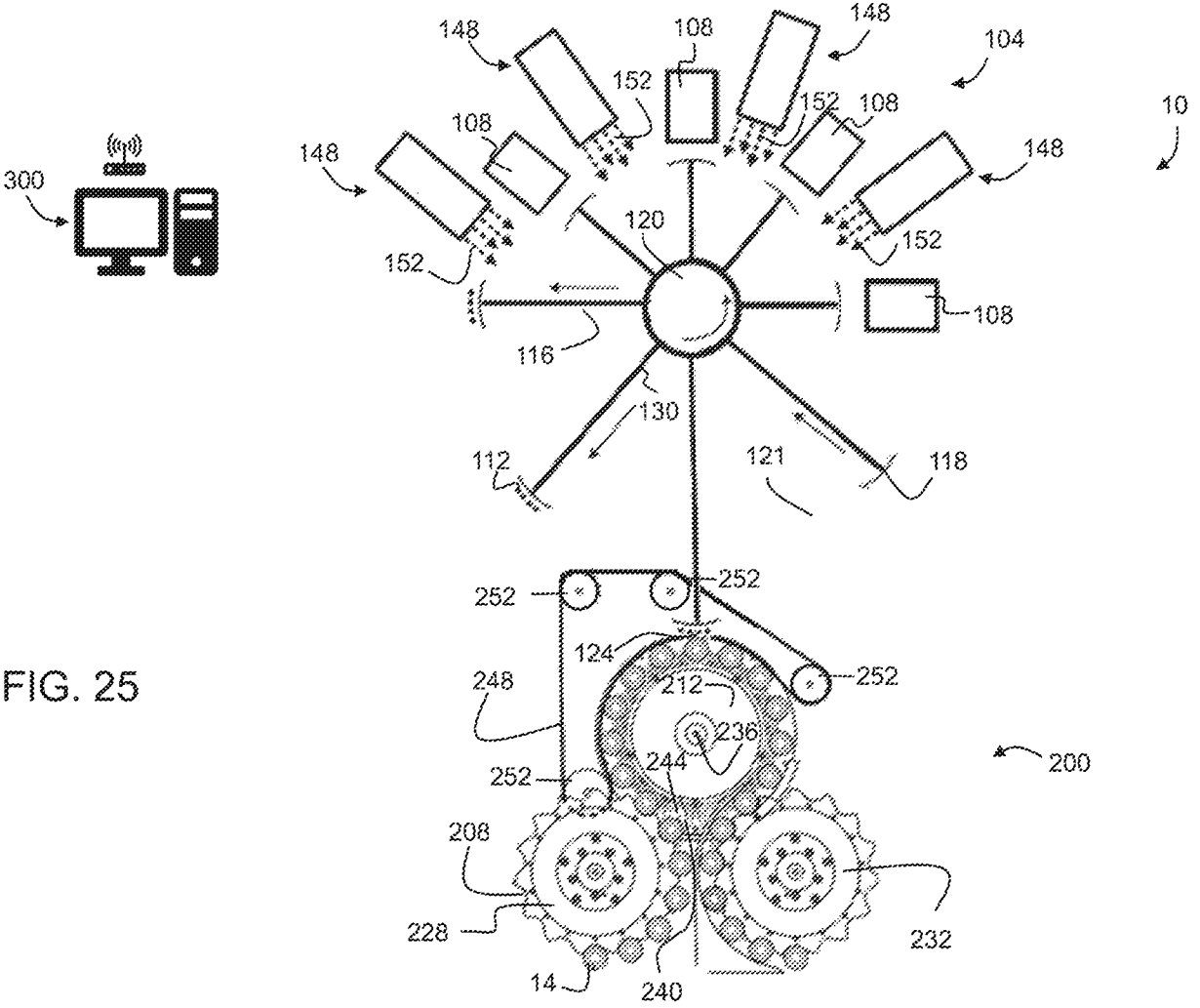
FIG. 25 is an embodiment of the invention showing a beverage can handling module featuring a rotary indexer and transfer wheels for delivering beverage container bodies to and from the indexer similar to FIG. 6 but incorporating a segmented image transfer blanket with variable gaps.
Figure 26:
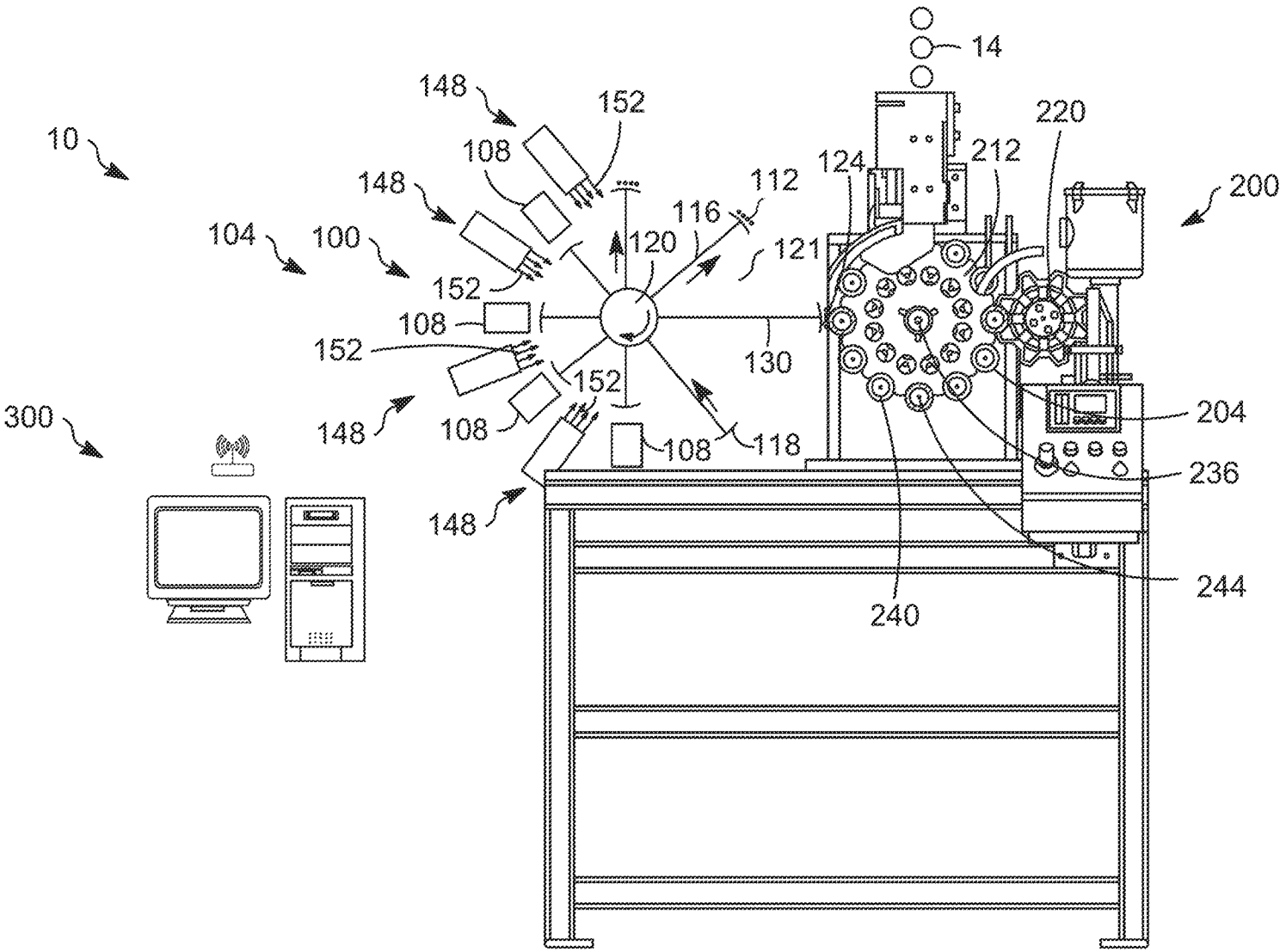
FIG. 26 is a table top beverage can decoration apparatus employing a single segmented image transfer blanket and a rotary beverage container handling module wherein the segmented image transfer blanket has extensible blanket segments.
Figure 27:
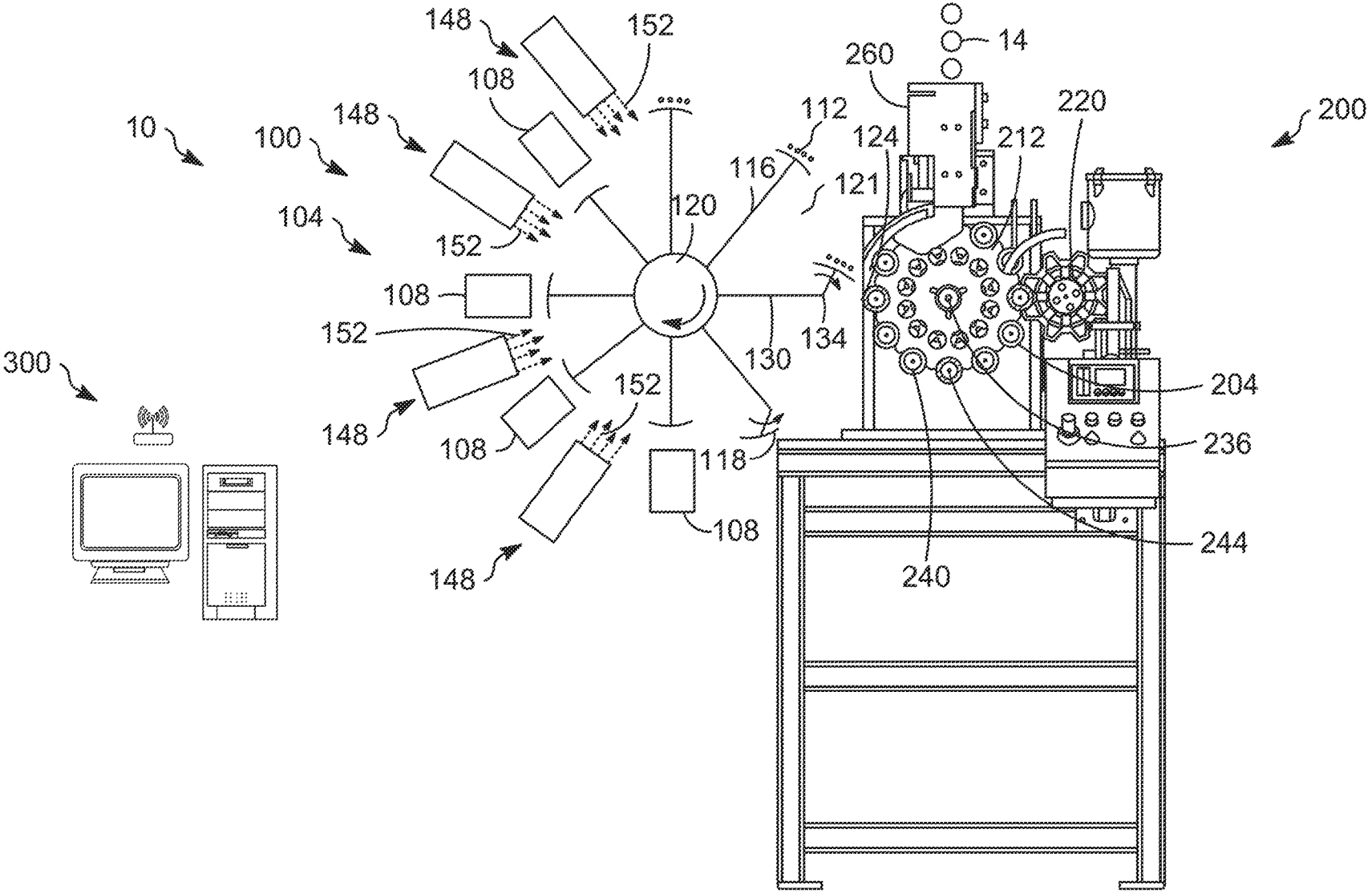
FIG. 27 is a table top beverage can decoration apparatus employing a single segmented image transfer blanket and a rotary beverage container handling module wherein the segmented image transfer blanket has deflectable blanket segments.

In FIGS. 6 and 25, the beverage container handling module 200 includes an indexer 212 for accepting the beverage container bodies 14 from a first transfer wheel or rotary delivery turret 228 and sequentially transferring the beverage container bodies along an indexed path comprising a plurality of dwell positions to a second transfer wheel or rotary delivery turret 232 and delivery from the beverage container handling module 200 to an exit conveyor or pin chain (not shown).

The indexer 212 is circumferential and rotates about a central hub 236. It has a plurality of pockets 208 adapted, as in sized and shaped, to support, control, and properly orient the sidewall 18 of the beverage container body 14 and to prevent misalignment of the beverage container body 14 through the decoration process. Each pocket 208 has a turntable 240 associated therewith, preferably a rotatable vacuum chuck 244 which utilizes a vacuum pressure to maintain the beverage container bodies 14 in position as the indexer 212 indexes or transports the beverage container bodies 14 through the decoration process as described above. Thus, the vacuum chucks 244 are each in fluid communication with a source of fluid pressure. The vacuum pressure is used to attach each beverage container body 14 to the turntables 240. The vacuum chucks 244 are rotatable about an axis that is at least a substantially horizontal axis, preferably a horizontal axis. The rotation of the vacuum chuck imparts a similar rotation to the beverage container body 14. The vacuum chucks 244 further may include a chuck nose that fits within a bottom domed portion of the beverage container body 14 to further support the beverage container body 14 through the decoration process.

The vacuum chucks 244 can be directly driven by motors or belt-driven. This enables a spinner belt 248 wound around a plurality of idler pulleys 252 to impart rotational movement to the beverage container bodies 14 attached to the vacuum chucks 244. The idler pulleys 252 are operably joined to a spinner motor which in turn drives the spinner belt 248. The spinner motor may be an AC motor.

An encoder may be used to track rotational movement of the indexer 212 and the turntables 240 and communicate the information to a computer for positional control. It communicates by taking the angular velocity of the pulley shaft and converting the information to digital data for use by the computer. There may be two encoders, one for the indexer 212 and one of the turntable 240 information.

As shown, the vacuum chucks 244 are driven by the spinner belt 248, achieving an identical angular rotation. One advantage of this spinner belt 248 system allows the beverage container bodies 14 to be stationary (i.e. not spinning) at infeed and discharge. Because they are not spinning, a vacuum can be used to pick up the beverage container body 14. The angular rotation remains constant between the vacuum chucks 244, which reduces potential beverage container body 14 damage.

This decorator 10 may run (i.e. decorate) at 300 beverage container bodies 14 per minute or more. This is based on the combined move time and dwell time required by the process. As the move time and the dwell time are reduced, throughput is increased. However, it is contemplated that this embodiment is capable of decorating 400 to 600 beverage container bodies 14 per minute. Adding additional beverage container handling modules 200 to the printing module 100 improves throughput to 1000 to 2000 beverage container bodies 14 per minute. A servo motor is used to control dwell and index time. Thus, the speed of the index and output of the software can be increased with less decoration. In other words, the rate of decoration of beverage container bodies 14 can be varied depending on the complexity of the ink 112 pattern and finished design.

A programmable controller which may be included with the computer system 300 is in communication with decorator 10, the one or more servo motors which drive the indexer 212 and the transfer wheels 228,232. It can be used to program the indexer 212 to any predetermined dwell time independent of the speed of the upstream and downstream processes to ensure a continuous processing of beverage container bodies 14 through the decorator 10. Thus, the decorator 10 can be programmed based on time without mechanical intervention.

The decorator 10 is programmable, and any number of dwell time preferences can be achieved on the same decorator 10 without the need for mechanical changes to the decorator 10.

Figure 14:
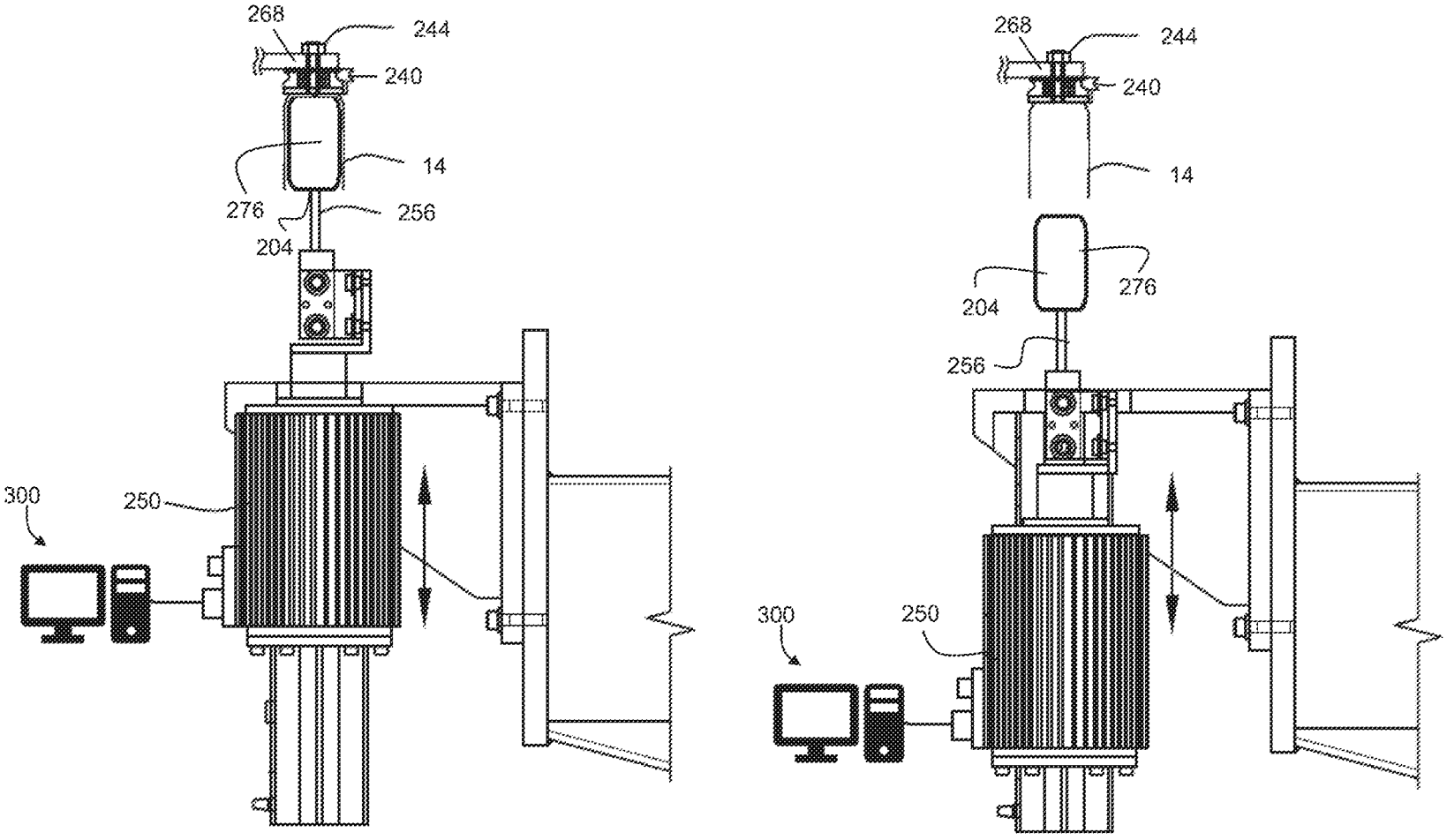
FIG. 14 is a top view of an arrangement for transferring an impression roll into and out of a beverage container body at a printing site which can be used in combination with the beverage container body handling modules illustrated in, for example, FIGS. 9-11.

An impression roll 204 may be inserted into the beverage container body at the printing site 124 during the dwell period during which the beverage container body 14 is printed or decorated. This may be accomplished by a relative movement between the impression roll 204 and the indexer 212 as illustrated in FIG. 14 or by transfer of the beverage container body 14 from the indexer 212 onto the impression roll 204 as illustrated in FIG. 15. Again, the impression roll 204 within the interior of the beverage container body 14 supports the sidewall 18 of the beverage container body 14 during ink 112 transfer to the sidewall 18 of the beverage container body 14 to prevent the sidewall 18 from collapsing under the force or pressure between the carousel 120/blanket segments 118 and the sidewall 18.

In this embodiment, the impression roll 204 is preferably inserted within the beverage container body 14 during a dwell period when the beverage container body 14 is located at the printing site 124. The left side of FIG. 14 shows the impression roll 204 within the beverage container body 14 while the right side of FIG. 14 shows the impression roll 204 withdrawn from the beverage container body 14. The impression roll 204 can be operated by a servo 250 which extends or pushes the impression roll 204 into the beverage container body 14 and withdraws the impression roll 204 from the beverage container body 14 post-decoration.

Preferably, this embodiment includes means for providing relative movement between the indexer 212 and the impression roll 204 wherein a distance between indexer 212 and the impression roll 204 may be reduced. Preferably, at least one impression roll 204 is capable of movement relative to a beverage container body 14 adhered to the indexer 212. This movement is preferably a linear movement to traverse the impression roll 204 from a first position to a second position within the opening 26 of the beverage container body 14 where the impression roll 204 provide support for the sidewall 18 during the printing process as described above. Regardless, the movement should be perpendicular to an imaginary plane defined by the opening 26 of the beverage container body 14. Typically, this imaginary plane is a vertical plane.

Alternatively, the impression roll 204 may be inserted within the beverage container body 14 during the dwell period using pressurized air 254 as shown in FIGS. 15 and 16. At the dwell position, the beverage container body 14 is removed from the indexer 212 and loaded onto the impression roll 204 coincident with the printing site 124. A force F provided by a source fluid pressure causes the beverage container body 14 to be removed from the indexer 212 and transferred onto the impression roll 204. Thus, the force F causes a movement M by a beverage container body 14 which transfers the beverage container body 14 from the indexer 212 at the dwell position onto and over or about impression roll 204 at the printing site 124 across the horizontal offset between dwell position and the printing site 124. The segmented image transfer blanket 116 is aligned with the impression roll 204 at the printing site 124.

Figure 9:
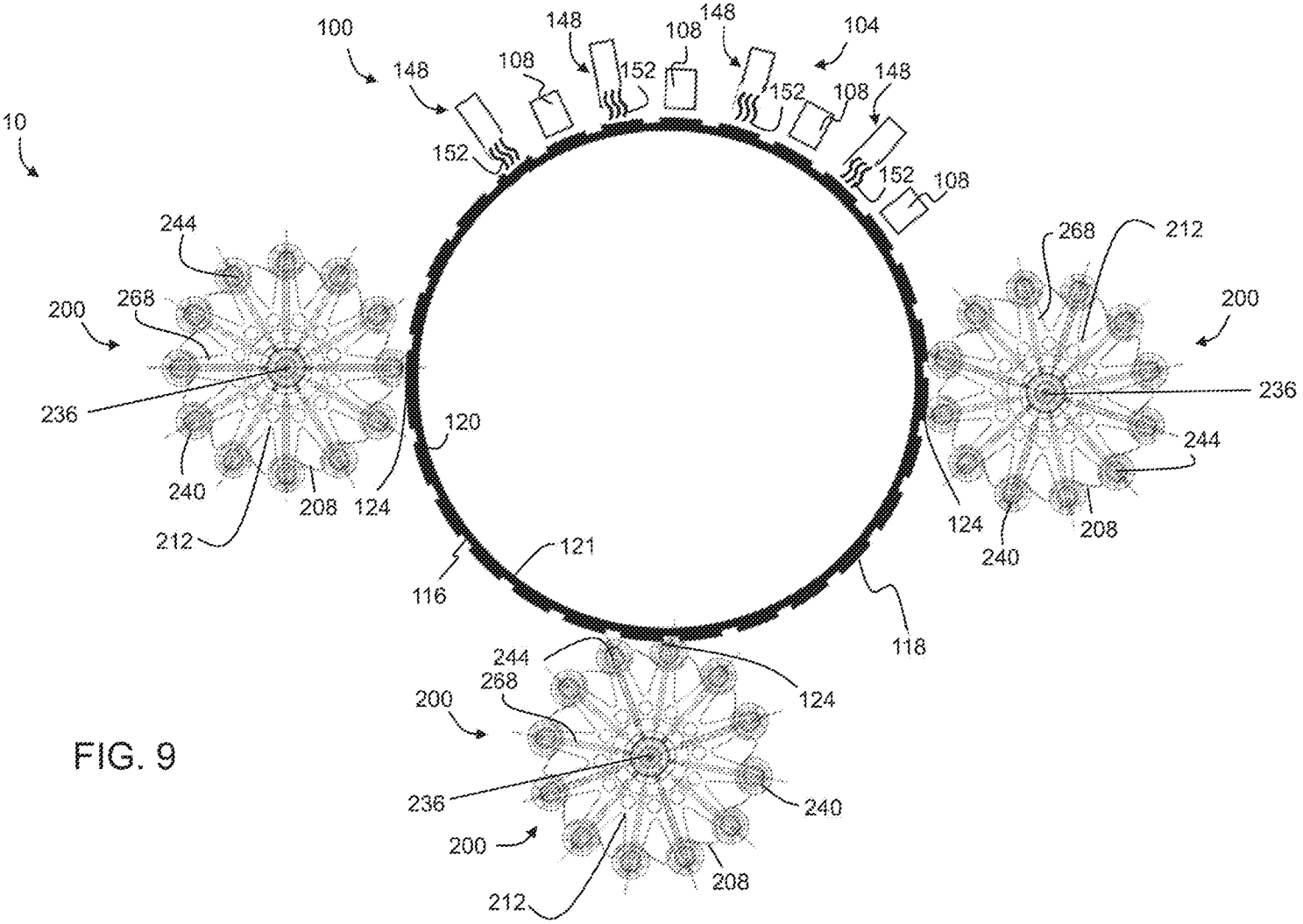
FIG. 9 is an embodiment of the invention showing multiple printing sites employing a single printing module and multiple rotary beverage container handling modules wherein a first beverage container handling module has an impression roll located at a first printing site, a second beverage container handling module has an impression roll offset (i.e. not located at) from a second printing site, and a third beverage container handling module has an impression roll offset (i.e. not located at) from a third printing site.
Figure 10:
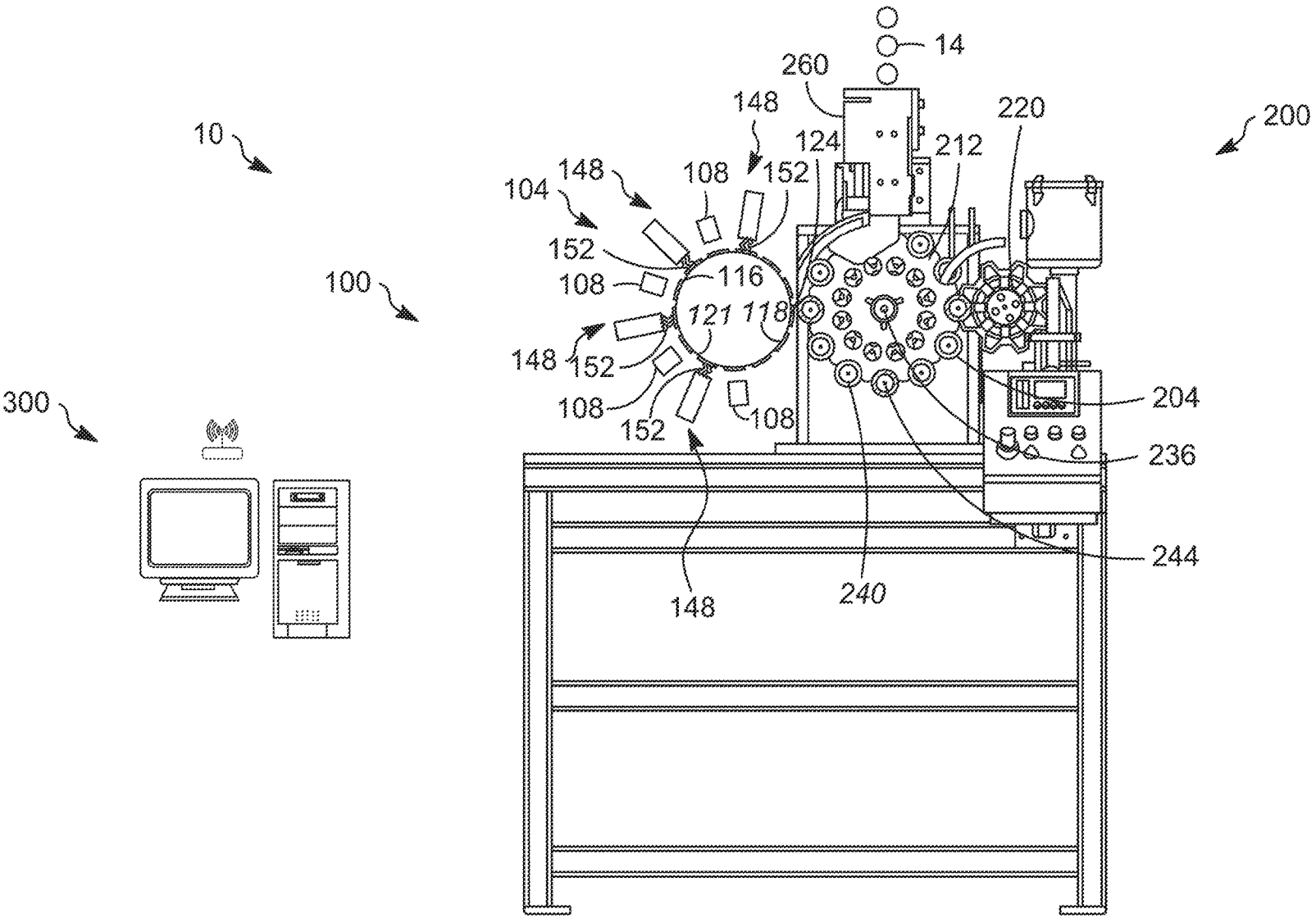
FIG. 10 is a table top beverage can decoration apparatus employing a single segmented image transfer blanket and a rotary beverage container handling module.
Figure 11:
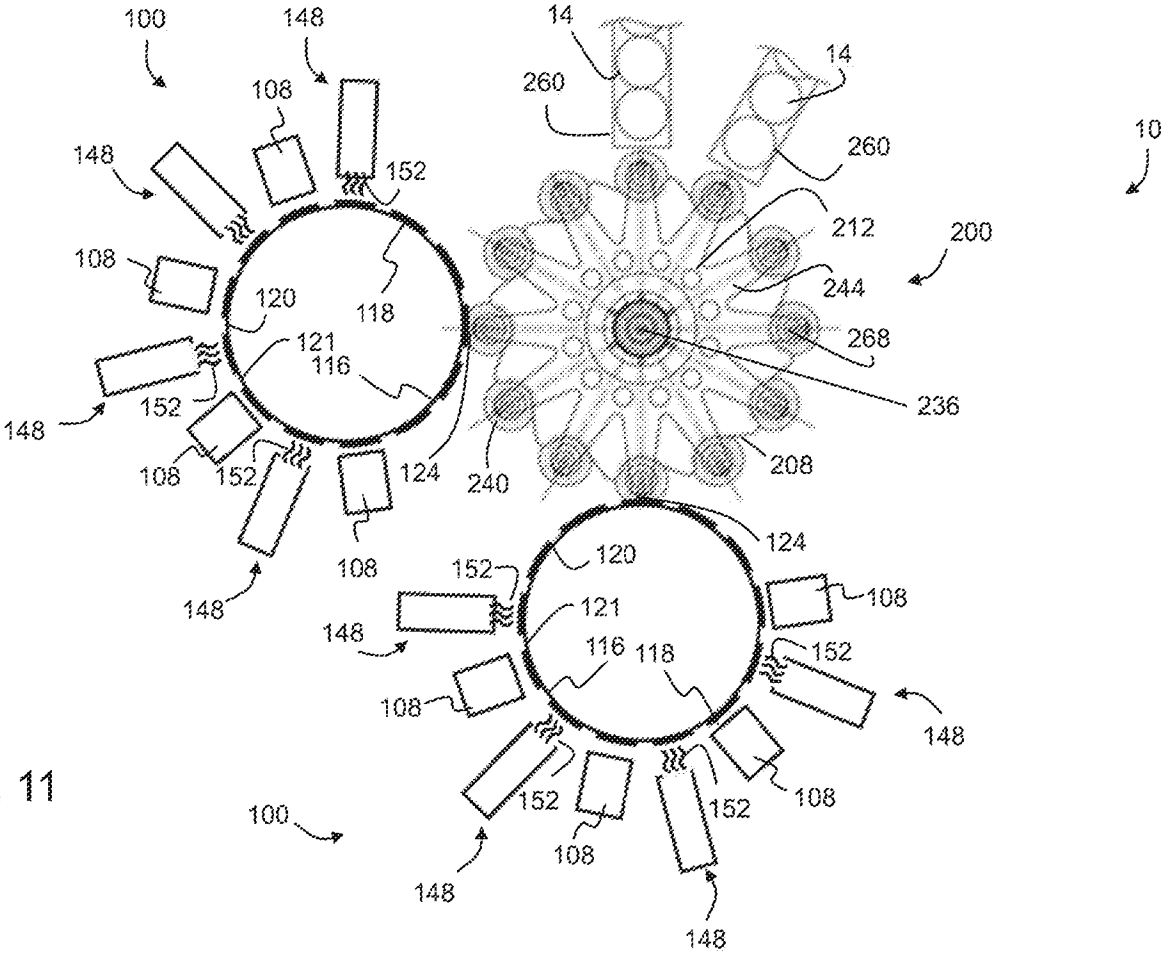
FIG. 11 is a table top beverage can decoration apparatus employing multiple printing modules and a single beverage container handling module.

Again, movement by the impression roll 204 can be accomplished by operably connecting or coupling the impression roll 204 to one or more servo motors 250. Preferably, each impression roll 204, if there is more than one printing site 124, see, for example, FIGS. 9 and 11, is coupled to a separate servo motor 250 such that each impression roll 204 is capable of movement independent of the other impression roll 204. The impression rolls 204 are attached to guide shafts 256 controlled, preferably directly controlled, by its corresponding servo 250. These servo motors 250 may also be used to impart rotation to the impression rolls 204 which transfer rotation to the beverage container bodies 14 during the printing operation. Alternatively, the impression rolls 204 can be freewheeling and rotation of the beverage container bodies 14 can be achieved through engagement with the segmented image transfer blanket 116.

Furthermore, the controller can synchronize a rotation of the indexer 212 with printing module 100. It generally follows that the programmable controller, which may be housed on the computer system 300, can be used to control the timing of not only the decorator 10 but also printing module 100 to ensure a smooth flow and processing of beverage container bodies 14 without unnecessarily long dwell times wherein beverage container bodies 14 rest without being decorated.

Figure 18:
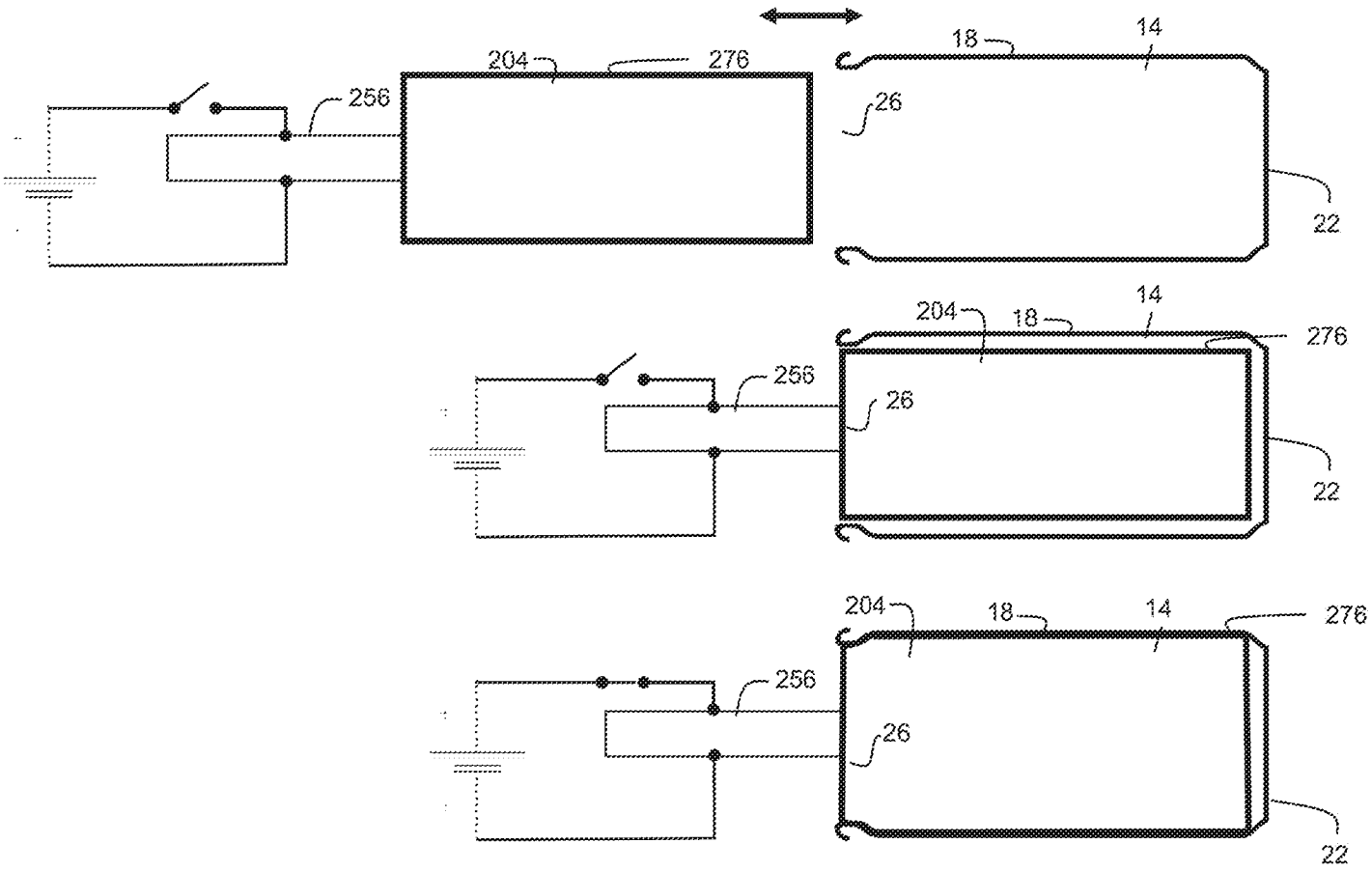
FIG. 18 is a side view of an impression roll of an electroactive polymer being inserted into and energized within a necked and flanged container body.

A unique problem is associated with decoration of beverage container bodies 14 that have undergone necking and flanging to reduce the opening in the open end 26 of the beverage container body 14 and ready it for filling and closing with a can end or lid by a double seaming operation. In these cases, the impression roll 204 diameter must be small enough to fit with the down-sized opening. Unfortunately, when the opening is reduced and the impression roll 204 diameter is reduced to fit within the interior space of the beverage container body 14, the impression roll 204 is no longer large enough to provide its function of supporting the sidewall 18 during printing. FIGS. 17 and 18 illustrate an expandable impression roll 204 using the technology discussed relative to the embodiments of FIGS. 14 and 15-16, respectively, to overcome this drawback. The impression roll 204 may be expandable by a fluid pressure or the like, but is preferable at least partially constructed from an electroactive polymer that changes dimension when stimulated by an electric field.

For example, as illustrated in FIGS. 17 and 18, relative movement between the impression roll 204 and the beverage container body 14 locates the impression roll 204 within an interior space of the necked and flanged beverage container body 14. When a voltage is applied from a source of voltage, the impression roll 204 diameter expands to engage and support a circumferential an inner surface of the interior space of the beverage container body 14. When the voltage is removed, the impression roll 204 returns to its original state, and the impression roll 204 can be removed from the beverage container body 14.

Now referring to the embodiments illustrated in FIGS. 7-12, these embodiments include one or more gravitational feeders 260, an indexer 212, and a transfer turret 220.

Further to the feeder 260, beverage container bodies 14 enter the decorator via the feeder 260. Gravity acts to transfer the beverage container bodies, one-by-one, through an entry chute 266, which delivers the beverage container bodies 14 to the indexer 212. This in-feed assembly allows for proper flow of the beverage container bodies 14 into the decorator 10. In some embodiments (see, e.g., FIG. 11, 28 or 29), multiple feeders 260 are provided. In the embodiment of FIG. 9, a feeder 260 (not shown for simplicity) would be associated with each indexer 212. In the embodiment of FIG. 11, two feeders 260 transfer beverage container bodies 14 to separate points along the indexer 212 as will be described in more detail below.

The indexer 212 sequentially transfers a plurality of beverage container bodies 14 along a predetermined fixed path through the decorating operation, to and through the printing site. The indexer 212 includes a star-shaped member having a plurality of legs 268 radiating outwardly from a center portion of the indexer 212 attached to a hub 236. Any number of legs 268 can be provided as feasibly possible.

These decorators 10 employ a first servo drive motor 250 which drives the indexer 212 to rotate about a central hub 236 joined to the first servo motor 250. The first servo motor 250 can be used to establish a dwell time, wherein the beverage container bodies 14 are stationary relative to the central hub 236 for a moment during which the ink 112 is transferred from the segmented image transfer blanket 116 to the beverage container sidewall 18. As the speed of the rotation of the indexer 212 is increased the dwell time decreases.

The first servo motor 250 may be further coupled to the transfer turret(s) 220 to provide synchronized rotational movement to the transfer turret 220 with the indexer 212.

The decorator 10 includes a computer 300 having a memory with a software stored thereon. The computer 300 acts as an external programmable controller which is in communication with printing module(s) 100 and the beverage container body handling modules(s) 200. Thus, the computer 300 can be used to program and control the first servo motor 250 to any predetermined dwell time independent of the speed of the indexer 212, which may also be controlled by the computer 300, by sending a signal thereto.

In the decorators 10 illustrated, there are twelve (12) legs 268 forming a 30-degree index. However, the inventors contemplate that the apparatuses disclosed herein may be provided with a 30-degree index, a 60-degree index, or any other degree index without departing from the scope of the invention. In other words, one indexer 212 as contemplated herein comprises a plurality of equally spaced index positions about a circumference of a rotational indexer 212.

At a terminal end of each leg 268, the indexer 212 has a vacuum chuck 244. The vacuum chucks 244 utilize a vacuum pressure to maintain the beverage container bodies in position as the indexer 212 indexes the beverage container bodies through the printing process. Thus, the vacuum chucks 244 are each in fluid communication with a source of fluid pressure. The vacuum pressure is used to attach each beverage container body to the indexer 212.

The vacuum chucks 244 are substantially free-wheeling. This enables a spinner belt 248 wound around a plurality of idler pulleys 252 to impart rotational movement to the beverage container bodies 14 attached to the vacuum chucks 244 if so desired. One of the idler pulleys 252 is operably joined to a spinner motor which in turn drives the spinner belt 248. One or more spinner gears may be provided to control the revolutions per minute of the beverage container bodies 14.

Each vacuum chuck 244 may be outfitted with a flag. As each chuck moves into a dwell position, the chuck pauses in front of a sensor. The sensor counts the number of times the flag passes and compares it against a preset count to insure the beverage container body 14 undergoes the proper number of revolutions.

The transfer turret 220 receives decorated beverage container bodies 14 from the indexer 212. This transfer typically occurs at the 270-degree index position in a counterclockwise cycle by the indexer 212, or the 3 o'clock position using a time clock reference. The transfer turret 220 transports decorated or adorned beverage container bodies 14 in a clockwise rotation to a pin chain 224. Beverage container bodies 14 exiting the decorator 10 via the transfer turret 220 are sent for further processing, packaging and delivery, filling, etc.

Like the embodiment of FIG. 6, the embodiments of FIGS. 7-12 include a means to locate an impression roll 204 within an interior of the beverage container body 14 during printing or decorating. This may include a means for relative movement between one or more impression rolls 204 and one or more printing sites rolls as illustrated in FIG. 14 or causing the beverage container body 14 to move with a fluid pressure as illustrated in FIGS. 15-16.

Figure 28:
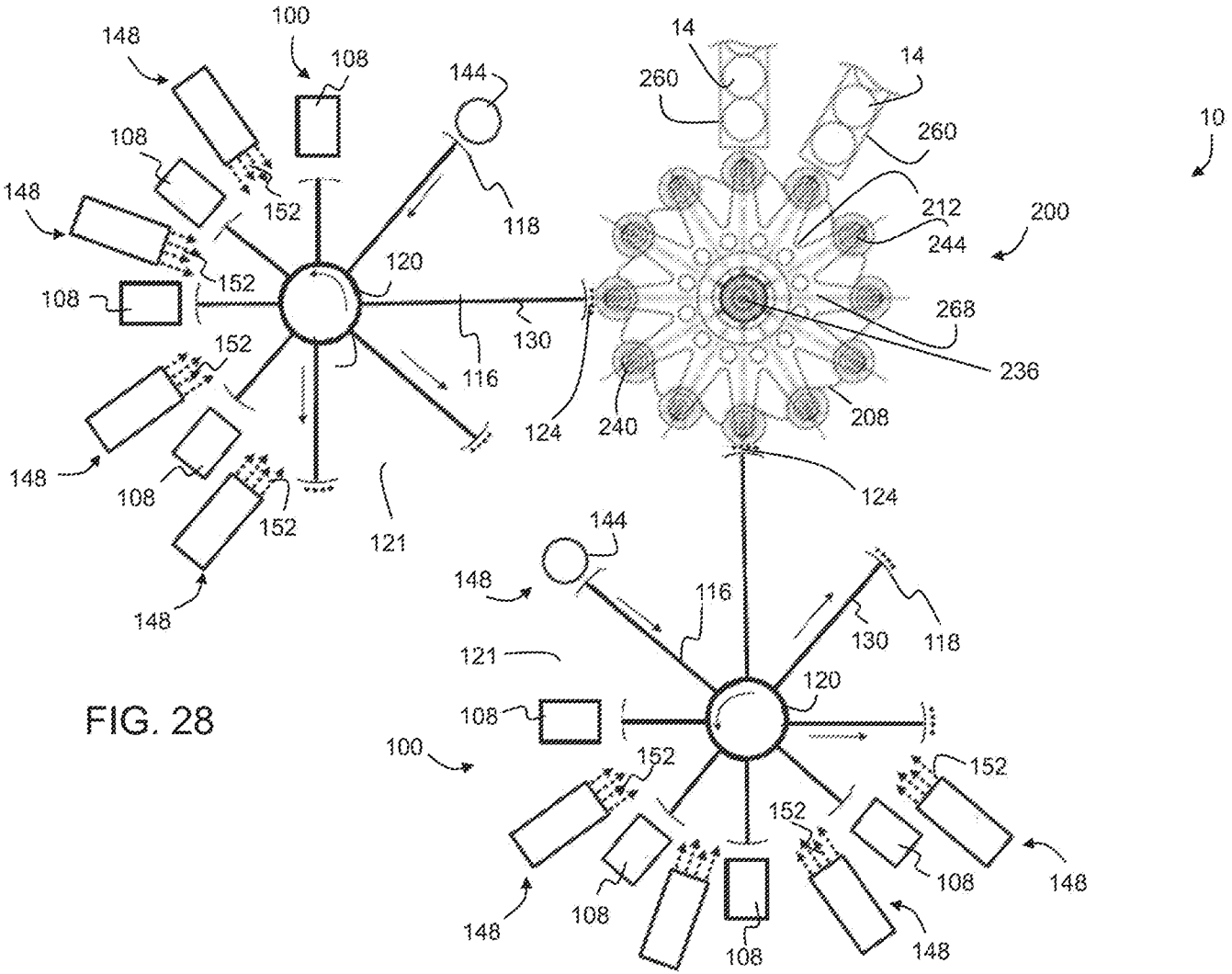
FIG. 28 is a table top beverage can decoration apparatus employing multiple printing modules incorporating segmented image transfer blanket having extensible blanket segments and a single beverage container handling module.
Figure 29:
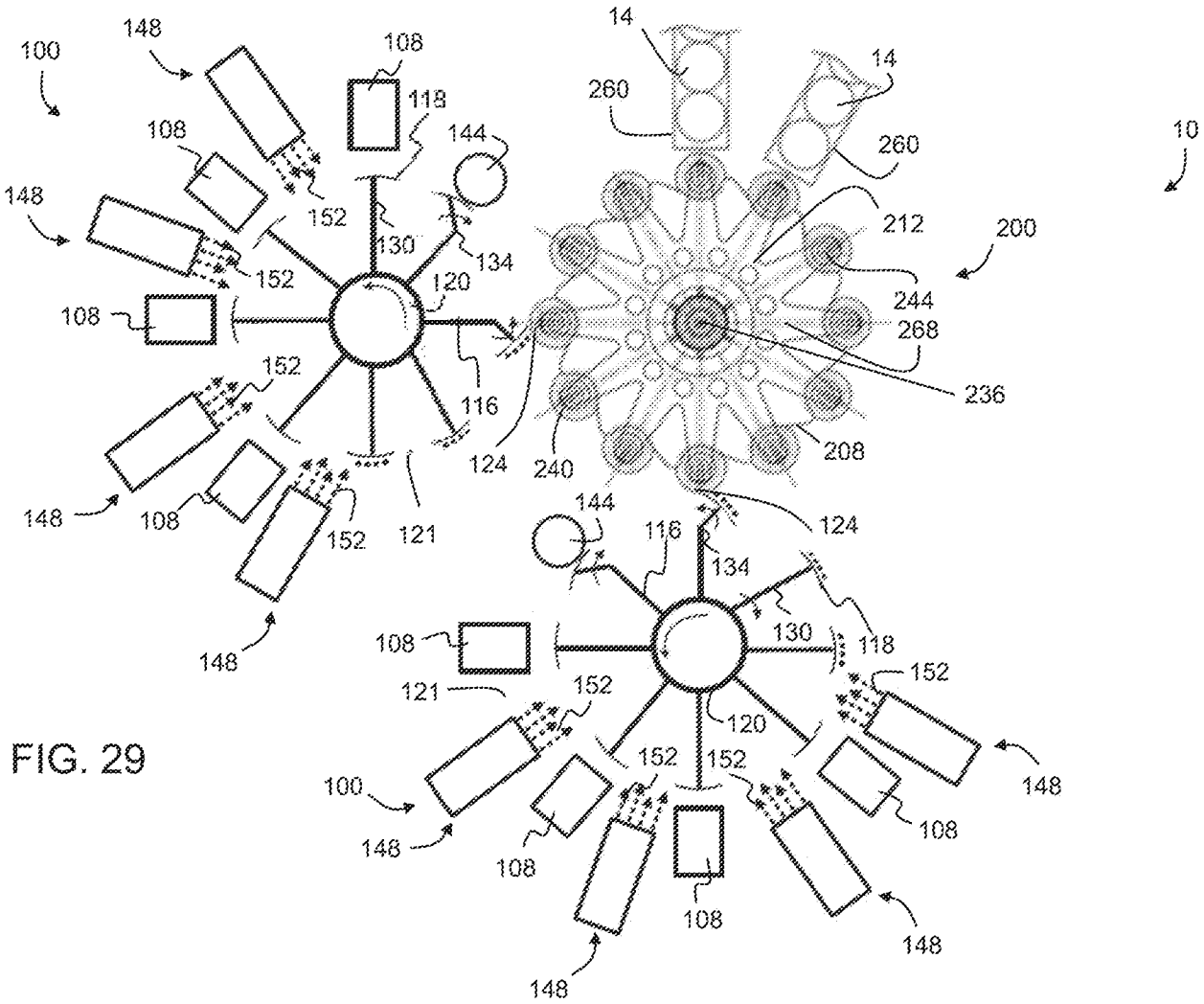
FIG. 29 is a table top beverage can decoration apparatus employing multiple printing modules incorporating segmented image transfer blanket having deflectable arms and a single beverage container handling module.
Figure 30:
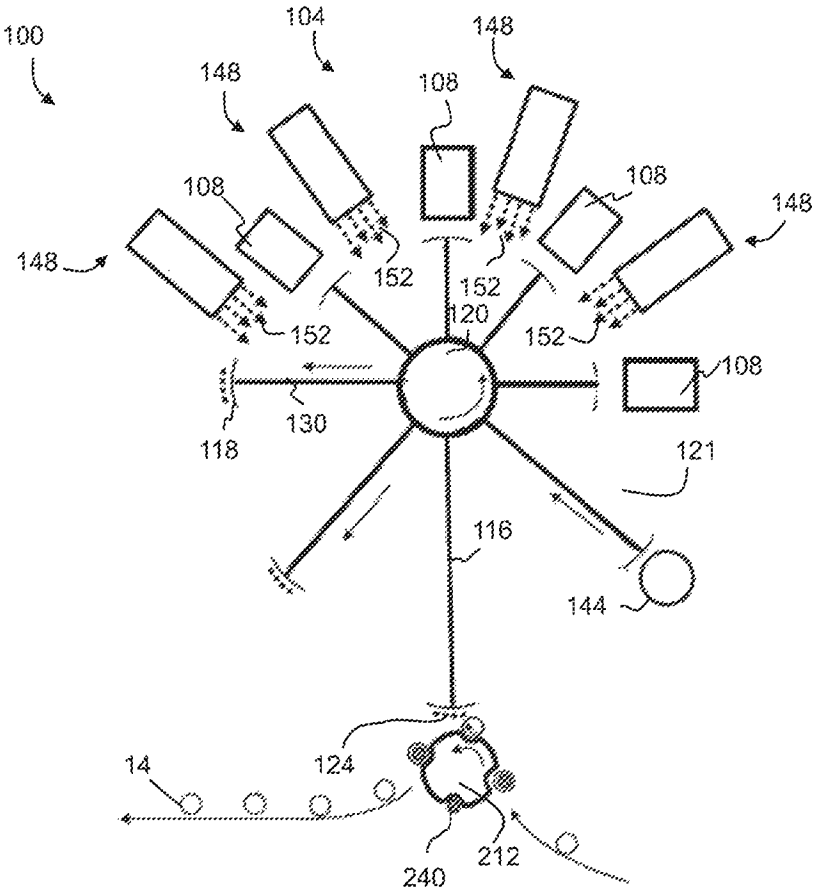
FIG. 30 is an embodiment of the invention showing a rotary beverage can handling module and a printing module incorporating a segmented image transfer blanket having extensible blanket segments.
Figure 31:
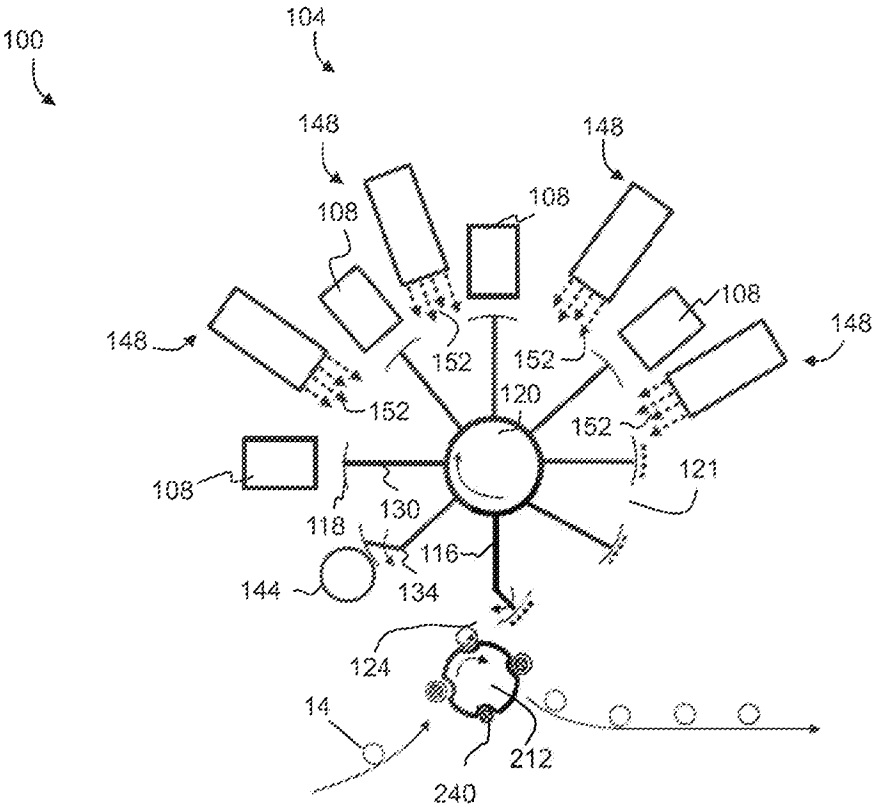
FIG. 31 is an embodiment of the invention showing a rotary beverage can handling module and a printing module incorporating a segmented image transfer blanket having deflectable arms.
Figure 32:
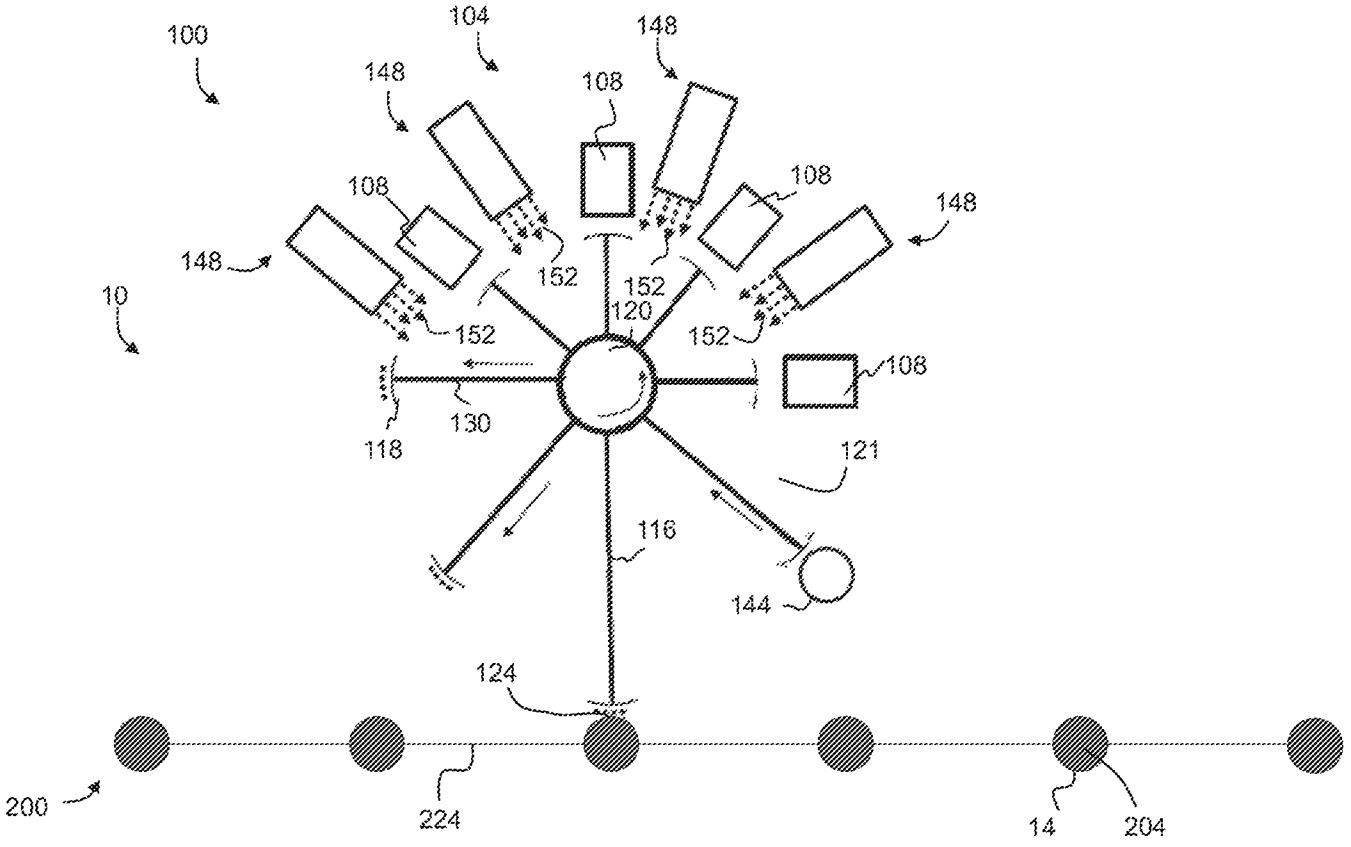
FIG. 32 is an embodiment similar to the embodiment of FIG. 4 wherein an embodiment of the invention a single printing module, including a segmented image transfer blanket having extensible blanket segments, and a single beverage container body handling module with a chain driven beverage container handling module.
Figure 33:
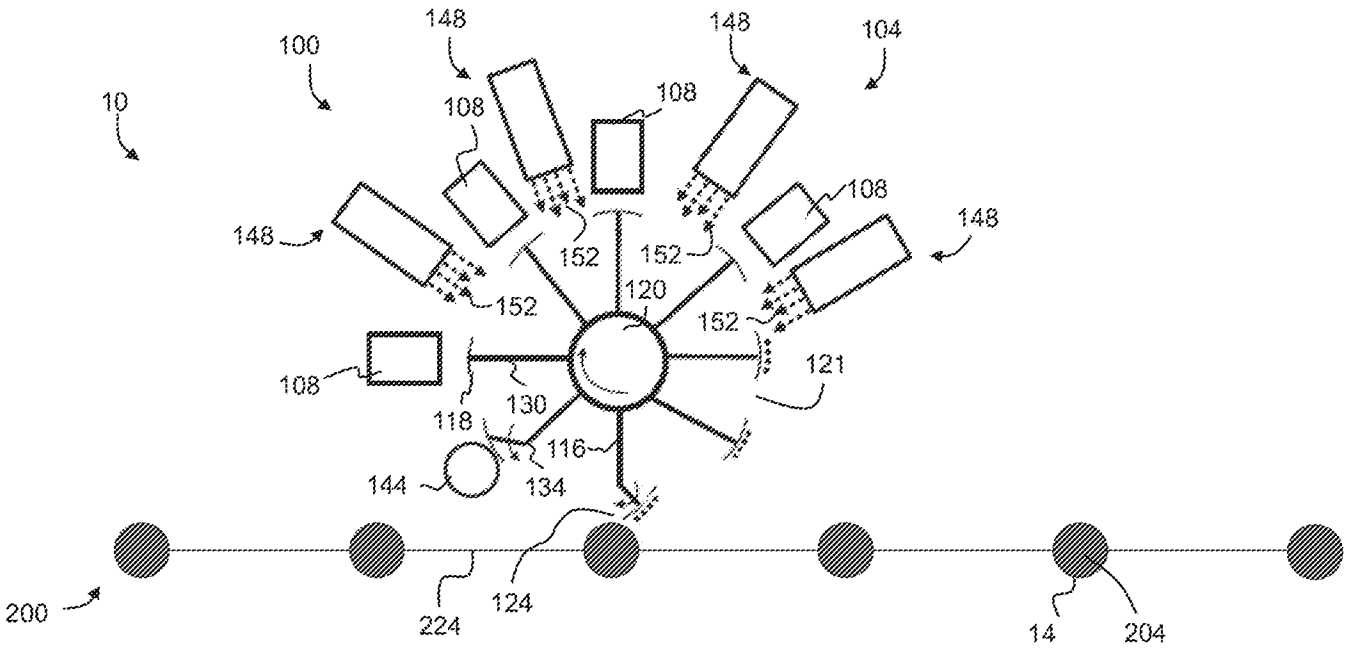
FIG. 33 is an embodiment similar to the embodiment of FIG. 4 wherein an embodiment of the invention a single printing module, including a segmented image transfer blanket having deflectable blanket segments, and a single beverage container body handling module with a chain driven beverage container handling module.
Figure 34:
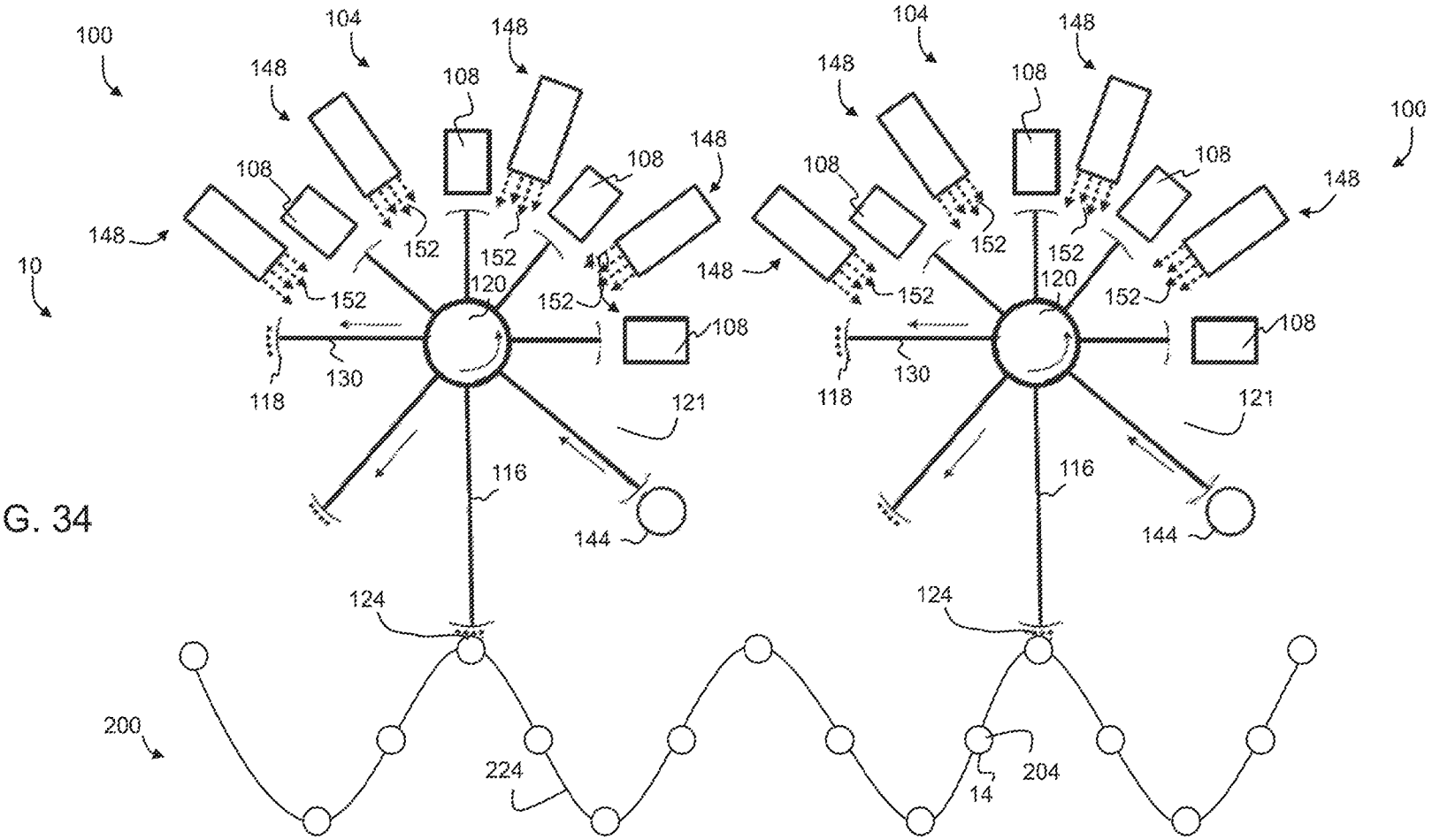
FIG. 34 is an embodiment similar to the embodiment of FIG. 5 wherein the embodiment features multiple printing sites on a single printing module, including a segmented image transfer blanket having deflectable blanket segments, and a single beverage container body handling module with a serpentine chain driven beverage container handling module.
Figure 35:
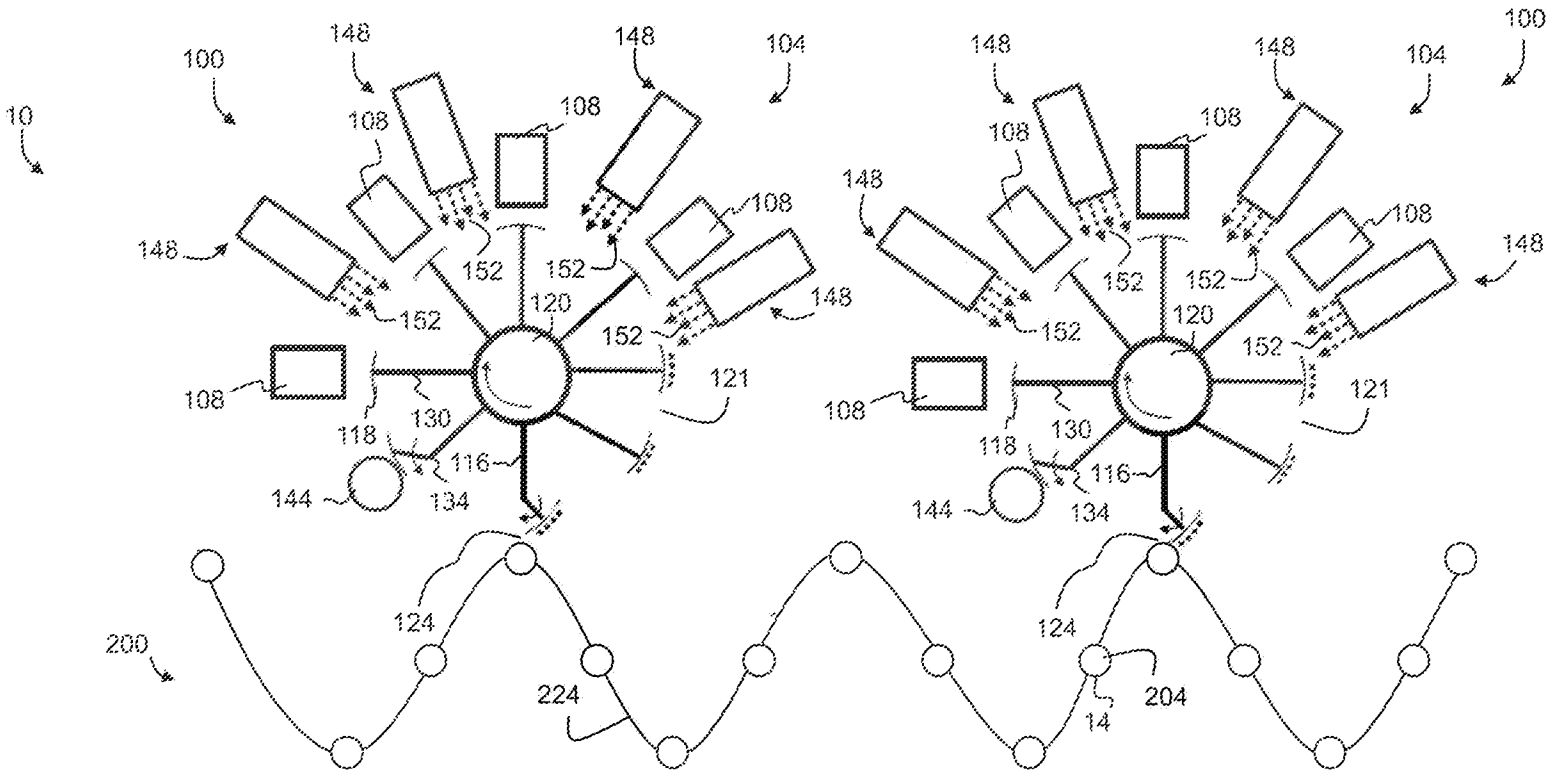
FIG. 35 is an embodiment similar to the embodiment of FIG. 5 wherein the embodiment features multiple printing sites on a single printing module, including a segmented image transfer blanket having extensible blanket segments, and a single beverage container body handling module with a serpentine chain driven beverage container handling module.
Figure 36:
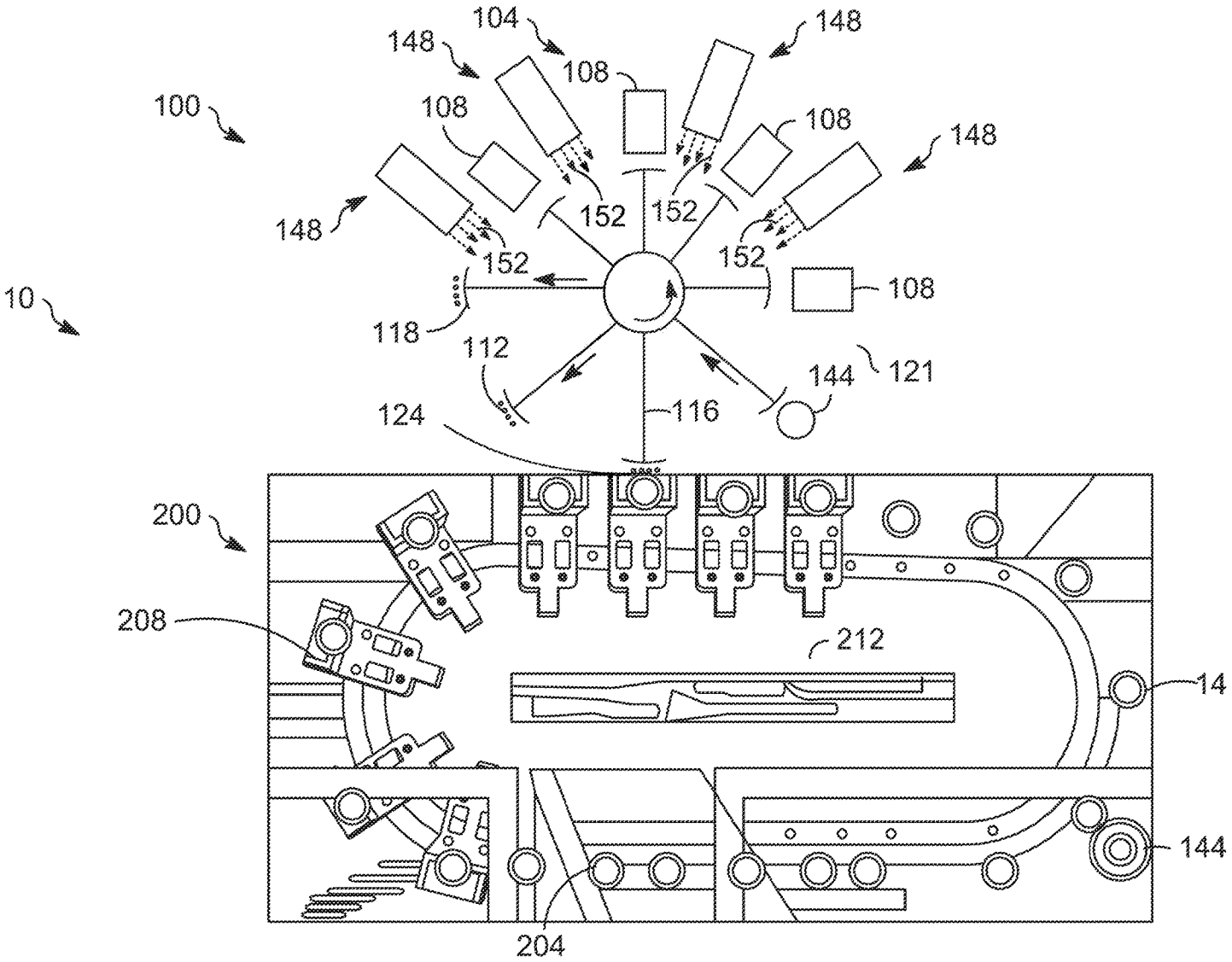
FIG. 36 is an embodiment similar to the embodiment of FIG. 3 wherein an embodiment of the present invention employs a single printing site along a circumference of a segmented image transfer blanket having extensible blanket segments and a beverage container body handling module comprises a means for transferring multiple impression rolls one-by-one to the printing site continuously and without interruption.
Figure 37:
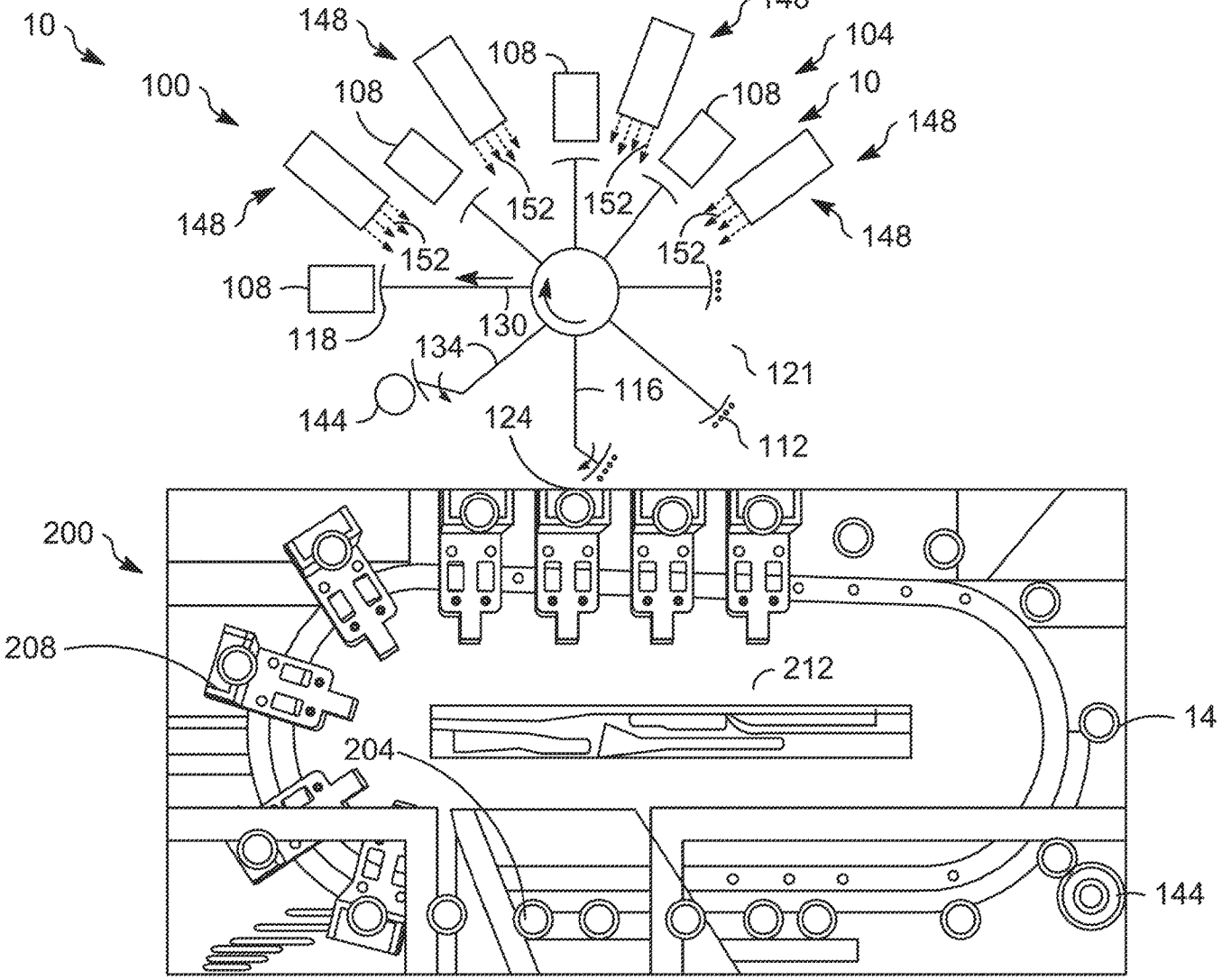
FIG. 37 is an embodiment similar to the embodiment of FIG. 3 wherein an embodiment of the present invention employs a single printing site along a circumference of a segmented image transfer blanket having deflectable blanket segments and a beverage container body handling module comprises a means for transferring multiple impression rolls one-by-one to the printing site continuously and without interruption.

As illustrated in FIGS. 9 and 11, multiple printing sites 124 can be incorporated using beverage container body handling module 200 described above. In FIG. 9, multiple beverage container handling modules 200 are incorporated with a single printing module 100 comprising a segmented image transfer blanket 116. In FIG. 9, much of the detail of the beverage container handling modules 200 has been removed for simplicity. In FIGS. 11, 28, and 29, multiple printing modules 100 are supplied with a single beverage container handling module 200.

Referring specifically to the embodiment illustrated in FIG. 9, three beverage container handling modules 200 are provided with a single segmented image transfer blanket 116. Each beverage container handling module 200 includes an indexer 212. Rotation of the indexers 212 is synchronized such that only one impression roll from one of the indexers 212 is positioned at a printing site 124 at a time. Once the impression roll 204 on a first indexer 212 rotates out of its printing site 124, an impression roll 204 on a second indexer 212 rotates into position at a printing site 124. Once the impression roll 204 on the second indexer 212 rotates out of its printing site 124, an impression roll 204 on a third indexer 212 rotates into position at a printing site 124. Once the impression roll 204 on the third indexer 212 rotates out of its printing site 124, an impression roll 204 on the first indexer 212 rotates into position at its printing site 124. This structure and method maintains continuous processing/decorating of container bodies 14 and quiets (i.e. reduces vibration, twisting, and other unwanted movements) the segmented image transfer blanket 116 during printing/ink image transfer to the container bodies 14.

Thus, it follows that an embodiment of the invention comprises a first and a second container body handling module 200. Each container body handling module 200 comprises a rotational indexer 212 configured to sequentially transport a plurality of container bodies to and from a respective printing site 124 of first and second printing sites 124. A plurality of impression rolls 204 is located about the rotational indexer 212 wherein the rotation indexer 212 rotates each impression roll 204 to its respective printing site 124 one at a time. A first impression roll 204 on the first indexer 212 rotates out of the first printing site 124 as a second impression roll 204 on the second indexer 212 rotates into position at the second printing site 124 simultaneously. None of the plurality of impression rolls 204 of the first indexer 212 are located at the first printing site 124 when any of the plurality of impression rolls 204 of the second indexer 212 is located at the second printing site 124. Likewise, none of the plurality of impression rolls 204 of the second indexer 212 are located at the second printing site 124 when any of the plurality of impression rolls 204 of the first indexer 212 is located at the first printing site 124.

Referring specifically to the embodiment illustrated in FIGS. 11, 28, and 29, one advantage of a 12-legged indexer 212 is that it may be used to process two or more beverage container bodies 14. For example, in the embodiment illustrated, two feeders 260 are provided at the 12 and 1 o'clock positions on the indexer 212 to simultaneously feed two beverage container bodies 14 to the indexer 212 at two different positions spaced by 30 degrees. By indexing 60 degrees counterclockwise, and by locating printing sites 90 degrees apart at the 9 and 6 o'clock positions, two beverage container bodies 14 can be decorated simultaneously.

The same principle can be used to print more than two beverage container bodies 14 simultaneously. For example, feeders 260 can deliver beverage can bodies to the 11, 12, 1, and 2 o'clock positions; printing sites can be located at the 10, 9, 8, and 7 o'clock positions; 4 printing modules 100 can be similarly located to correspond with the printing site 124 locations; and the indexer 212 can index by 90-degree increments. It follows that this example would result in 4 beverage container bodies 14 being simultaneously decorated upon each 90-degree index increment and dwell.

One of ordinary skill in the art would readily grasp that the embodiment illustrated in FIG. 11 could be operated according to the principles disclosed in FIG. 9. Namely, a first printing site 124 transfers ink to a beverage container body 14 while a second printing site 124 awaits the arrival of an impression roll 204 carrying a second beverage container body 14 to the second printing site. Thus, it follows that an embodiment of the invention comprises a first and a second printing module 100 and a single container body handling module 200. The container body handling module 200 comprises a rotational indexer 212 configured to sequentially transport a plurality of container bodies to and from a first and second printing sites 124, associated with the first and second printing modules 100, respectively. A plurality of impression rolls 204 is located about the rotational indexer 212 wherein the rotation indexer 212 rotates each impression roll 204 to a printing site 124 one at a time.

Figure 12:
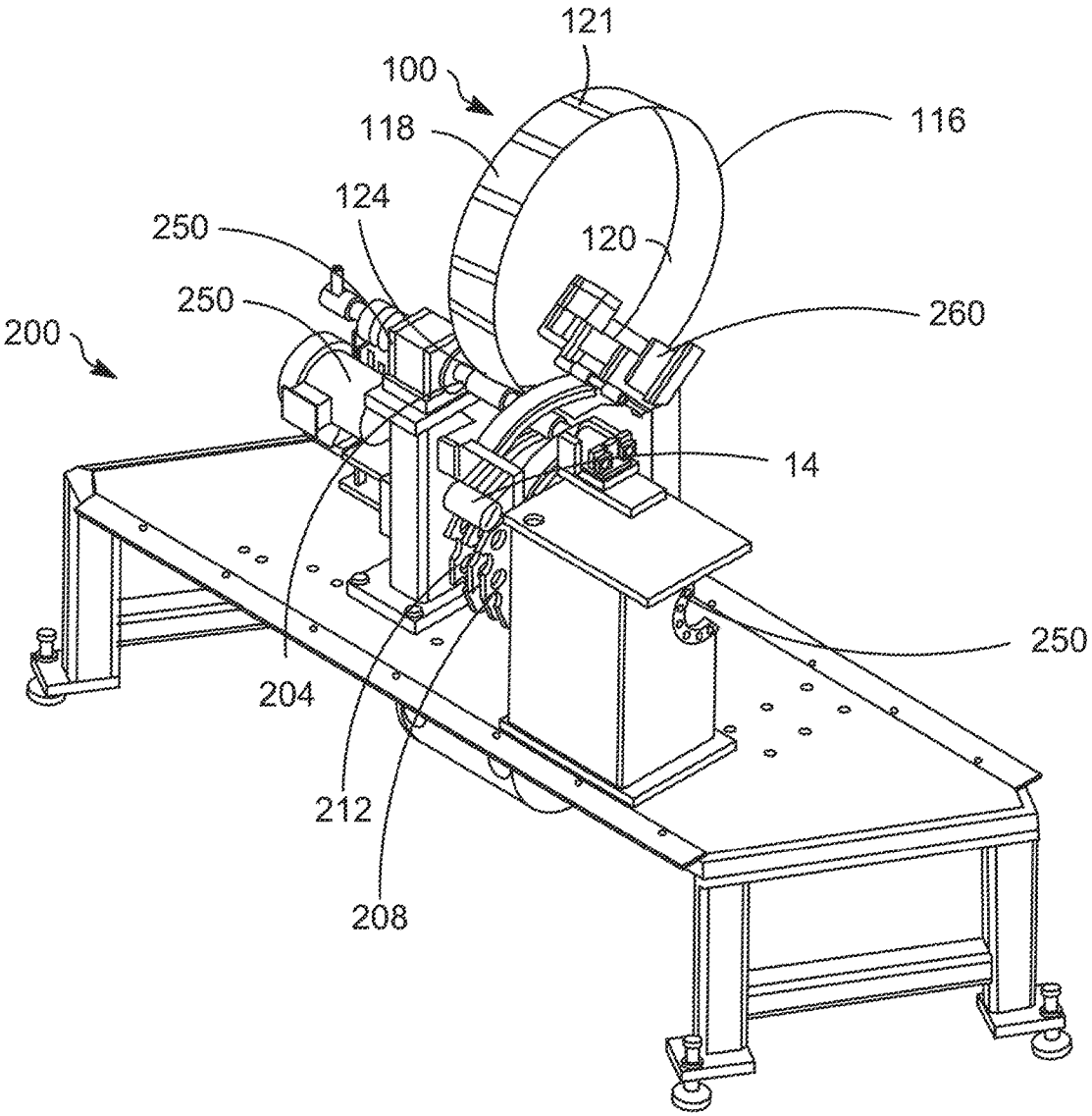
FIG. 12 is an alternative table top beverage can decoration apparatus employing a single printing module and a single beverage container body handling module.

Referring specifically to the embodiment of FIG. 12, the beverage can bodies 14 can be removed from the indexer 212 to undergo a print operation. The beverage container body 14 is loaded onto the impression roll 204 at the printing site 124. Here, the printing site 124 is spaced from the indexer 212 such that the beverage container bodies 14 must be removed from the indexer 212 from decoration and returned to the indexer 212 post-decoration. The transfer means illustrated in FIGS. 15 and 16 is particularly useful in this embodiment.

Referring generally to the illustrated embodiments, it is preferable for the beverage container body 14 to rotate with rotation of the impression roll 204. The spin speed of the impression roll 204 may be variable to match the movement of the segmented image transfer blanket 116. The impression roll 204 rotation speed is variable to minimize image transfer time. It may be provided by a variable frequency drive. It could also be servo controlled, DC motor controlled, or by other means.

The impression roll 204 is similarly shaped to the beverage container bodies 14. Accordingly, it has a generally cylindrical sidewall 276 separating a distal end of the impression roll 204 from a proximal end of the impression roll 204 wherein the impression roll 204 is insertable within the beverage container bodies 14 such that the distal end is positioned adjacent an enclosed bottom of the beverage container bodies 14 and the proximal end is positioned adjacent an open end of the beverage container bodies 14. The proximal end is attached to a shaft which is joined to a motor to drive rotation of the impression roll. The impression roll 204 spins about a central, generally horizontal, axis which corresponds to a similar axis of the beverage container body 14 when it is located at the dwell position such that beverage container body transfer from the dwell position to the printing site 124 is facilitated (see FIG. 15).

The arrangement of the impression roll 204 within the interior of the beverage container body 14, of course, can be accomplished by passing the beverage container body 14 over the impression roll 204 as previously described.

The embodiment of FIG. 13 includes first and second segmented image transfer blankets 116 running parallel to side-by-side beverage container handling module 200. This embodiment can be used with a pair of beverage container handling modules 200, such as those shown in FIGS. 10 and 12. However, one of ordinary skill in the art would readily understand that the beverage container handling modules 200 would function identically.

The Computer System

In addition to the functions previously described, the computer system 300 includes a memory on which one or more software routines are stored. The computer 300 acts as controller that sends signals to the elements of the decorators. The computer 300 provides controls, commands, or signals which determine a shape of the desired pattern of ink 112 transferred from the plurality of ink-jet printing heads 108 to the printing surface 132 of the segmented image transfer blanket 116. A length of the desired pattern of ink 112 on the segmented image transfer blanket 116 preferably corresponds to a length of a segment of the segmented image transfer blanket 116 which is either less than or equal to a circumference of each beverage container body 14 or greater than or equal to a circumference of each beverage container body 14.

Using the computer system 300 in combination with the printing modules 100 and the beverage container handling module 200, the beverage container body decorators 10 continuously and without interruption decorates a queue of substantially identical beverage container bodies 14 with a plurality of finished arts wherein each finished art in the plurality of finished arts is unique relative to a remaining population of finished arts in the plurality of finished arts. In other words, there is no limit to the number of different finished designs or ink patterns that can be delivered to consecutively decorated beverage container bodies 14.

The computer system 300 described herein can be used in conjunction with any of the apparatuses described. Communication between the computer system and the decorating apparatus can be achieved via a conventional wireless signal using, for example, a modem or the like, as shown, or via a conventional wire signal, as also shown.

Methods of Decorating

While several methods of decorating container bodies have been expressly and inherently described with respect to the embodiments described above, the inventors further contemplate the following methods.

A first container body decorating method comprises the steps of: (1) delivering an ink pattern from an inker unit comprising a plurality of ink-jet printing heads to a segmented image transfer blanket; (2) providing a plurality of impression rolls, each impression roll inserted within an interior space of a corresponding container body in a plurality of container bodies to support the corresponding container body thereon; (3) transferring each of the impression rolls one-by-one to a printing site; rotating the segmented image transfer blanket to transport the ink image to the printing site; (4) engaging each container body one-by-one with the segmented image transfer blanket at the printing site; (5) rotating each container body during a corresponding engaging step; and (6) transferring the ink pattern to each container body during a corresponding rotating step. The step of transferring the ink pattern to each container body during a corresponding rotating step may be performed continuously, without interruption, on the plurality of container bodies delivered consecutively to the printing site. Alternatively, the transferring each of the impression rolls to a printing site step may be performed by an indexer which indexes each container body to the printing site, wherein the transferring the ink pattern to the container body during a corresponding rotating step is performed during a dwell period, and wherein the indexer is stationary with respect to the transferring each of the impression rolls to a printing site step. A rotation may be imparted to each container body by a rotation of the impression roll. Alternatively, a rotation may be imparted to each container body through engagement with the segmented image transfer blanket. Each impression roll may be produced from an electroactive polymer.

The first method may further comprise the step of: transferring each container body to a corresponding impression roll wherein each corresponding impression roll is located within an interior space of each container body and a sidewall of each container body is supported thereby during the transferring the ink pattern to the container body during a corresponding rotating step.

The first method may further comprise the steps of: expanding each impression roll within the corresponding container body prior to the rotating step.

The first method may further comprise the step of: contracting each impression roll within the corresponding container body subsequent to the rotating step.

The first method may further comprise the step of: engaging the segmented image transfer blanket with a pressure member located opposite the impression roll during transferring the ink pattern to each container body during a corresponding rotating step.

A second container body decorating method comprising the steps of: (1) delivering an ink pattern from an inker unit comprising a plurality of ink-jet printing heads to a segmented image transfer blanket; (2) providing an impression roll; providing relative movement between the impression roll and a corresponding container body in a plurality of container bodies; (3) locating the impression roll within an interior space of the corresponding container body to support the corresponding container body thereon at a printing site; (4) rotating the segmented image transfer blanket to transport the ink image to the printing site, wherein the segmented image transfer belt comprises a plurality of blanket segments, wherein each blanket segment is separated from an adjacent blanket segment by a gap, wherein a length of each gap is variable, and wherein each length can be selectively enlarged or contracted during printing; (5) engaging the corresponding container body with the segmented image transfer blanket at the printing site; (6) rotating each container body during the engaging step; and (7) transferring the ink pattern to the container body during the rotating step.

While the specific embodiments have been illustrated and described, numerous modifications come to mind without significantly departing from the spirit of the invention, and the scope of protection is only limited by the scope of the accompanying Claims.

What is claimed is:

1. A container body decorator comprising:

a controller having a software routine stored on a memory;

a plurality of ink-jet printing heads in communication with the controller;

a segmented image transfer blanket having a circumferential configuration comprising a plurality of print surfaces each separated by a gap in the segmented image transfer blanket;

a printing site; and a container body handling module, wherein the container body handling module comprises a plurality of impression rolls movable relative to the printing site, wherein each impression roll in the plurality of impression rolls transports one container body in the plurality of container bodies to the printing site, and wherein each container body in the plurality of container bodies contacts a printing surface of the segmented image transfer blanket at the printing site without subsequently contacting any other printing surfaces in the plurality of printing surfaces.

2. The container body decorator of claim 1 wherein each impression roll is configured to fit within an interior of each container body in a plurality of generally identical unadorned container bodies to be decorated by the container body decorator.

3. The container body decorator of claim 1 wherein the plurality of impression rolls are attached to an indexer which rotates about a central hub such that the impression rolls orbit the central hub.

4. The container body decorator of claim 3 wherein each impression roll rotates about a corresponding center axis which is unique to each impression roll.

5. The container body decorator of claim 4 wherein engagement between a container body and the segmented image transfer blanket imparts rotation to the container body on a respective impression roll.

6. The container body decorator of claim 5 wherein each impression roll transfers rotation to one container body in the plurality of container bodies about the corresponding center axis while the one container body is located at the printing site and contacting the segmented image transfer blanket.

7. The container body decorator of claim 6 wherein the plurality of ink-jet printing heads transfer ink in a desired pattern to each printing surface of the segmented image transfer blanket, wherein the segmented image transfer blanket traverses along a blanket path defined by a carousel to which a plurality of blanket segments comprising the plurality of printing surfaces are attached to deliver the desired pattern to the printing site.

8. The container body decorator of claim 7 wherein each blanket segment engages the carousel of the segmented image transfer blanket at the printing site such that printing surface carrying the desired pattern of ink is forced against one of the plurality of container bodies supported on one of the plurality of impression rolls as the one of the plurality of container bodies rotates about the center axis of the one of the plurality of impression rolls as the one of the plurality of impression rolls also orbits the central hub.

9. The container body decorator of claim 8 wherein forced air is used to deliver a container body onto an impression roll.

10. The container body decorator of claim 9 wherein a mechanical force is used to deliver a container body onto an impression roll.

11. The container body decorator of claim 10 wherein a shape of the desired pattern of ink transferred from the plurality of ink-jet printing heads is controlled by the controller.

12. The container body decorator of claim 11 wherein a volume of the desired pattern of ink transferred from the plurality of ink-jet printing heads is controlled by the controller.

13. The container body decorator of claim 12 wherein a length of the desired pattern of ink on the segmented image transfer blanket corresponds to a length of a printing surface of each blanket segment of the segmented image transfer blanket which is less than or equal to a circumference of each container body in the plurality of container bodies.

14. The container body decorator of claim 13 wherein a length of the desired pattern of ink on the segmented image transfer blanket corresponds to a length of the printing surface of each blanket segment which is greater than or equal to a circumference of each container body in the plurality of container bodies.

15. The container body decorator of claim 1 wherein the container body decorator continuously and without interruption decorates a queue of substantially identical container bodies with a plurality of finished arts.

16. The container body decorator of claim 1 wherein each finished art in the plurality of finished arts is unique relative to a remaining population of finished arts in the plurality of finished arts.

17. The container body decorator of claim 1 wherein the plurality of inkjet printers apply ink directly to the segmented image transfer blanket.

18. The container body decorator of claim 1 wherein a cleaner member engages each printing surface to remove excess ink from the segmented image transfer blanket.

19. The container body decorator of claim 18 wherein the cleaner member is selected from the group consisting of a cleaner roll, a scraper, a brush, a fluid bath, a fluid sprayer member, and any combination thereof.

20. The container body decorator of claim 1 wherein the segmented image transfer blanket comprises one or more relief features engraved into each printing surface.

21. The container body decorator of claim 1 comprising a plurality of printing sites.

22. The container body decorator of claim 21 wherein the container handling module comprises a plurality of indexers, each comprising a plurality of impression rolls.

23. The container body decorator of claim 1 the container body handling module includes a serpentine path followed by a plurality of impression rolls, wherein each container body in a plurality of container bodies is supported on a corresponding impression roll in the plurality of impression rolls.

24. The container body decorator of claim 1 wherein the segmented image transfer blanket may be selectively disengaged or spaced from the printing site wherein a container body selectively bypasses contact with the segmented image transfer blanket, or wherein a container body is selectively disengaged or spaced from the segmented image transfer blanket at the printing site wherein the container body selectively bypasses contact with the segmented image transfer blanket.

25. The segmented image transfer blanket of claim 1 wherein a gap between adjacent blanket segments has a surface height which is recessed in relation to the printing surfaces of the adjacent blanket segments.

26. A container body decorator comprising:

a controller having a software routine stored on a memory;

a plurality of ink-jet printing heads in communication with the controller;

a segmented image transfer blanket having a circumferential configuration comprising a plurality of print surfaces each separated by a gap in the segmented image transfer blanket;

a printing site; and a container body handling module, wherein a relief band is recessed into each printing surface of the segmented image transfer blanket and is configured to align with an edge of an open end of a container body such that the edge is spaced from the printing surface during a transfer of ink from the segmented image transfer blanket to the container body.

* * * * *